US009474427B2

(12) United States Patent
Lee et al.

(10) Patent No.: US 9,474,427 B2
(45) Date of Patent: Oct. 25, 2016

(54) ROBOT CLEANER AND METHOD FOR CONTROLLING THE SAME

(71) Applicant: SAMSUNG ELECTRONICS CO., LTD., Suwon-si, Gyeonggi-do (KR)

(72) Inventors: Jong Gap Lee, Gwangju (KR); Jeong Gon Song, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/661,380

(22) Filed: Mar. 18, 2015

(65) Prior Publication Data

US 2015/0265125 A1 Sep. 24, 2015

(30) Foreign Application Priority Data

Mar. 20, 2014 (KR) ..... 10-2014-0032528

(51) Int. Cl.

| | |
|---|---|
| ***G01C 22/00*** | (2006.01) |
| ***A47L 11/40*** | (2006.01) |
| ***A47L 9/28*** | (2006.01) |

(52) U.S. Cl.

CPC ..... *A47L 11/4061* (2013.01); *A47L 9/2805* (2013.01); *A47L 11/4066* (2013.01); *A47L 2201/04* (2013.01)

(58) Field of Classification Search

None

See application file for complete search history.

(56) References Cited

U.S. PATENT DOCUMENTS

2008/0039974 A1* 2/2008 Sandin ..... G05D 1/028 700/258
2015/0234385 A1* 8/2015 Sandin ..... G05D 1/0265 700/258

FOREIGN PATENT DOCUMENTS

| | | |
|---|---|---|
| JP | 2008-146617 | 6/2008 |
| KR | 1996-0006869 | 3/1996 |
| KR | 10-2013-0053286 | 5/2013 |

OTHER PUBLICATIONS

Decision to Grant issued on Aug. 3, 2016 in corresponding European Patent Application No. 15 156 606.4.

* cited by examiner

*Primary Examiner* — Adam Alharbi

(74) *Attorney, Agent, or Firm* — Staas & Halsey LLP

(57) ABSTRACT

A robot cleaner is provided. The robot cleaner includes a main body forming an exterior; a floor detection sensor for detecting a distance from the main body to a floor surface; a tilt sensor for detecting inclination of the main body; and a controller for determining whether there is a protruding part that protrudes from a floor surface in a running path of the main body, based on a first sensor value output by the floor detection sensor and a second sensor value output by the tilt sensor. In accordance with embodiments of the present disclosure, a robot cleaner may properly move around and perform vacuuming by taking into account conditions of a floor surface. It may also smoothly climb over a doorsill and dynamically change its running pattern based on the presence/absence and position of an obstacle in climbing the doorsill.

27 Claims, 19 Drawing Sheets

ROBOT CLEANER AND METHOD FOR CONTROLLING THE SAME

CROSS-REFERENCE TO RELATED APPLICATIONS

This application claims the benefit under 35 U.S.C. §119 (a) of a Korean patent application filed on Mar. 20, 2014 in the Korean Intellectual Property Office and assigned Serial No. 10-2014-0032528, the entire disclosure of which is incorporated hereby incorporated by reference.

BACKGROUND

1. Field

The present disclosure relates to a robot cleaner and method for controlling the same.

2. Description of the Related Art

Robots have generally been developed for industrial use and to perform factory automation tasks. Recently, robot applications have been further extended to the medical and aerospace fields, e.g., and even for use in the home to perform various housekeeping tasks.

An example of a home robot is a robot (vacuum) cleaner, which intelligently vacuums an area by sucking dust or foreign materials from the floor surface while moving around the area in a self-guided and propelled manner. The robot cleaner detects e.g., obstacles in the cleaning area with e.g., various sensors, and controls a running path and cleaning operations of the robot cleaner based on the result of the detecting of the obstacles.

An early version of the robot cleaner vacuumed randomly while moving around by itself, and might leave some areas uncleaned due to the presence of an obstacle or a particular condition of the floor surface. To supplement the shortcomings of the existing robot cleaner, technologies have been developed to perform vacuuming by partitioning an entire cleaning area into multiple cleaning areas or cells, or by making a cleaning map and distinguishing cleaned areas from uncleaned areas (i.e., areas to be cleaned) within the cleaning map. Technologies for determining whether to climb or to detour an obstacle based on the presence of the obstacle and conditions of the floor surface have also been developed and are being progressively advanced.

SUMMARY

The present disclosure provides a robot cleaner and method for controlling the same, and more particularly, a robot cleaner and method for controlling the same that determines conditions of a floor surface and accordingly controls moving and cleaning operations.

In accordance with an aspect of the present disclosure, a robot cleaner is provided. The robot cleaner includes a main body forming an exterior; a floor detection sensor for detecting a distance from the main body to a floor surface; a tilt sensor for detecting inclination of the main body; and a controller for determining whether there is a projecting or protruding part that protrudes from a floor surface in a running path of the main body, based on a first sensor value output by the floor detection sensor and a second sensor value output by the tilt sensor.

The protruding part may include a doorsill.

The controller may initially determine whether there is the protruding part based on the first sensor value, and finally determine whether there is the protruding part based on the second sensor value.

The controller may initially determine whether there is the protruding part based on a difference between the first sensor values that vary in time.

The controller may, for each time area in which multiple first sensor values are output, determine whether a difference between a maximum value and a minimum value among the multiple first sensor values exceeds a predetermined first determination value, and determine that there is the protruding part if the difference exceeds the first determination value.

The first determination value may be set depending on a brightness level of the floor surface.

The controller may determine whether the second sensor value exceeds a predetermined second determination value, and finally determine that there is the protruding part if the second sensor value exceeds the second determination value.

The robot cleaner may further include a driving unit for controlling drive wheels equipped in the main body to have the main body climb over the protruding part.

The driving unit may control the drive wheels to drive the main body to climb over the protruding part in a zigzag running pattern.

The driving unit may control the drive wheels to drive the main body along a running pattern that changes according to a position of an obstacle in climbing the protruding part.

The driving unit may control the drive wheels to drive the main body in a left/right zigzag running pattern in which the main body moves to the left and then to the right, if there is an obstacle to the right of the protruding part.

The driving unit may control the drive wheels to drive the main body in a right/left zigzag running pattern in which the main body moves to the right and then to the left, if there is an obstacle to the left of the protruding part.

In accordance with another aspect of the present disclosure, a method for controlling a robot cleaner is provided. The method includes detecting a distance between a main body and a floor surface with a floor detection sensor; detecting inclination of the main body with a tilt sensor; and determining whether there is a protruding part that protrudes from a floor surface in a running path of the main body, based on a first sensor value output from the floor detection sensor and a second sensor value output from the tilt sensor.

The protruding part may include a doorsill.

Determining whether there is a protruding part may include initially determining whether there is the protruding part based on the first sensor value, and finally determining whether there is the protruding part based on the second sensor value.

Determining whether there is a protruding part may include initially determining whether there is the protruding part based on a difference between the first sensor values that vary in time.

Determining whether there is a protruding part may include, for each time area in which multiple first sensor values are output, determining whether a difference between a maximum value and a minimum value among the multiple first sensor values exceeds a predetermined first determination value, and determining that there is the protruding part if the difference exceeds the first determination value.

The first determination value may be set depending on a brightness level of the floor surface.

Determining whether there is a protruding part may include determining whether the second sensor value exceeds a predetermined second determination value, and determining that there is the protruding part if the second sensor value exceeds the predetermined second determination value.

The method may further include controlling drive wheels equipped in the main body to have the main body climb over the protruding part.

Controlling drive wheels may include controlling the drive wheels to drive the main body to climb over the protruding part in a zigzag running pattern.

Controlling drive wheels may include controlling the drive wheels to drive the main body along a running pattern that changes according to a position of an obstacle in climbing the protruding part.

Controlling drive wheels may include controlling the drive wheels to drive the main body in a left/right zigzag running pattern in which the main body moves to the left and then to the right, if there is an obstacle to the right of the protruding part.

Controlling drive wheels may include controlling the drive wheels to drive the main body in a right/left zigzag running pattern in which the main body moves to the right and then to the left, if there is an obstacle to the left of the protruding part.

In accordance with an aspect of the present disclosure, a method of controlling a robot cleaner configured to clean a floor surface is provided. The method includes detecting an obstacle, determining whether the obstacle is on a first side or a second side of the robot cleaner, detecting whether there is a protrusion from the floor surface, and controlling the robot cleaner to move in a first pattern to climb the protrusion and to avoid the obstacle if the obstacle is determined as being on the first side or to move in a second pattern to climb the protrusion and to avoid the obstacle if the obstacle is determined as being on the second side.

The first pattern includes a zigzag pattern moving away from the obstacle on the first side and then toward the obstacle on the first side and the second pattern includes a zigzag pattern moving away from the obstacle on the second side and then toward the obstacle on the second side.

In accordance with an aspect of the present disclosure, a robot cleaner is provided. The robot cleaner includes a tilt sensor for measuring an inclination amount of the robot cleaner, a first floor detection sensor, disposed at a front portion of the robot cleaner, for detecting a first distance from a floor to the robot cleaner, a second floor detection sensor, disposed at a portion of the robot cleaner other than the front portion, for detecting a second distance from the floor to the robot cleaner, and a controller to extract minimum and maximum values among sensor values of the first and second floor detection sensor, and to determine that the robot cleaner is climbing a protrusion from the floor surface when the difference between the minimum and maximum values is determined to be greater than a first threshold and when the inclination amount of the tilt sensor exceeds a second threshold.

Other aspects, advantages, and salient features of the disclosure will become apparent to those skilled in the art from the following detailed description, which, taken in conjunction with the annexed drawings, discloses exemplary embodiments of the disclosure.

BRIEF DESCRIPTION OF THE DRAWINGS

The above and other features and advantages of the present disclosure will become more apparent by describing in detail exemplary embodiments thereof with reference to the attached drawings in which.

Throughout the drawings, like reference numerals will be understood to refer to like parts, components, and structures.

DETAILED DESCRIPTION

Figure 1:
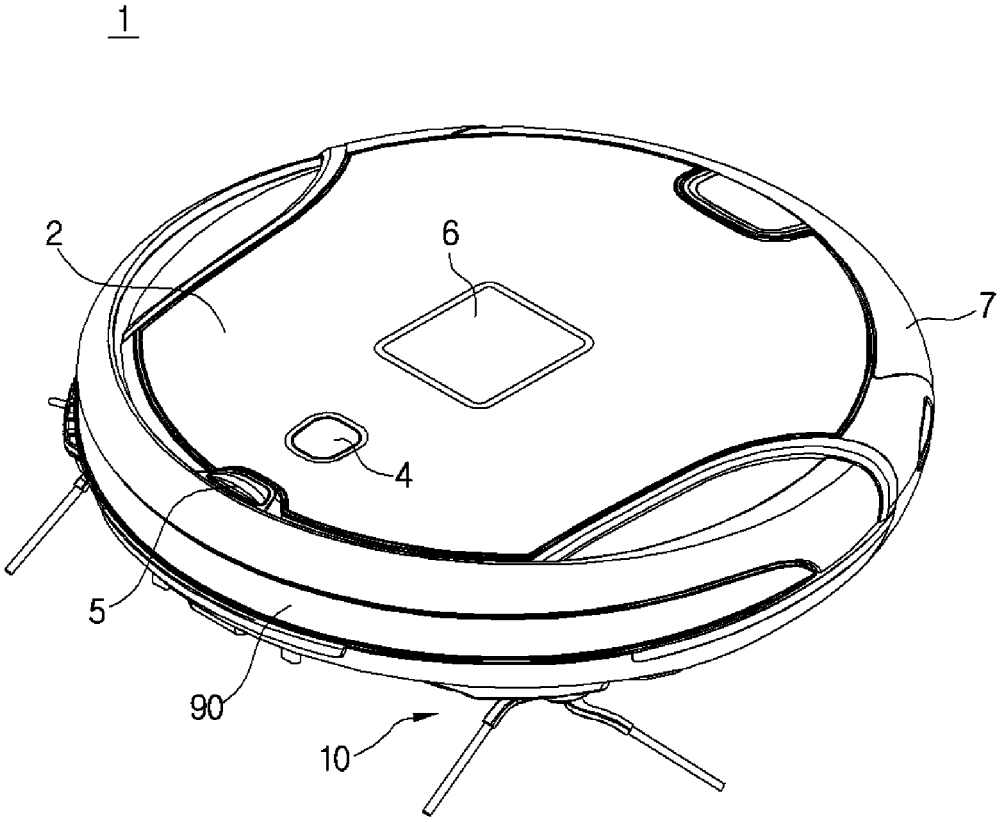
FIG. 1 is a perspective view of a robot cleaner, in accordance with an embodiment of the present disclosure.

The present disclosure will now be described more fully with reference to the accompanying drawings, in which exemplary embodiments of the disclosure are shown. The disclosure may, however, be embodied in many different forms and should not be construed as being limited to the embodiments set forth herein; rather, these embodiments are provided so that this disclosure will be thorough and complete, and will fully convey the concept of the disclosure to those skilled in the art. Like reference numerals in the drawings denote like elements, and thus their description will be omitted. In the description of the present disclosure, if it is determined that a detailed description of commonly-used technologies or structures related to the embodiments of the present disclosure may unnecessarily obscure the subject matter of the invention, the detailed description will be omitted. It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section.

Embodiments of a robot controller and method for controlling the same will now be described in detail with reference to accompanying drawings.

Figure 2:
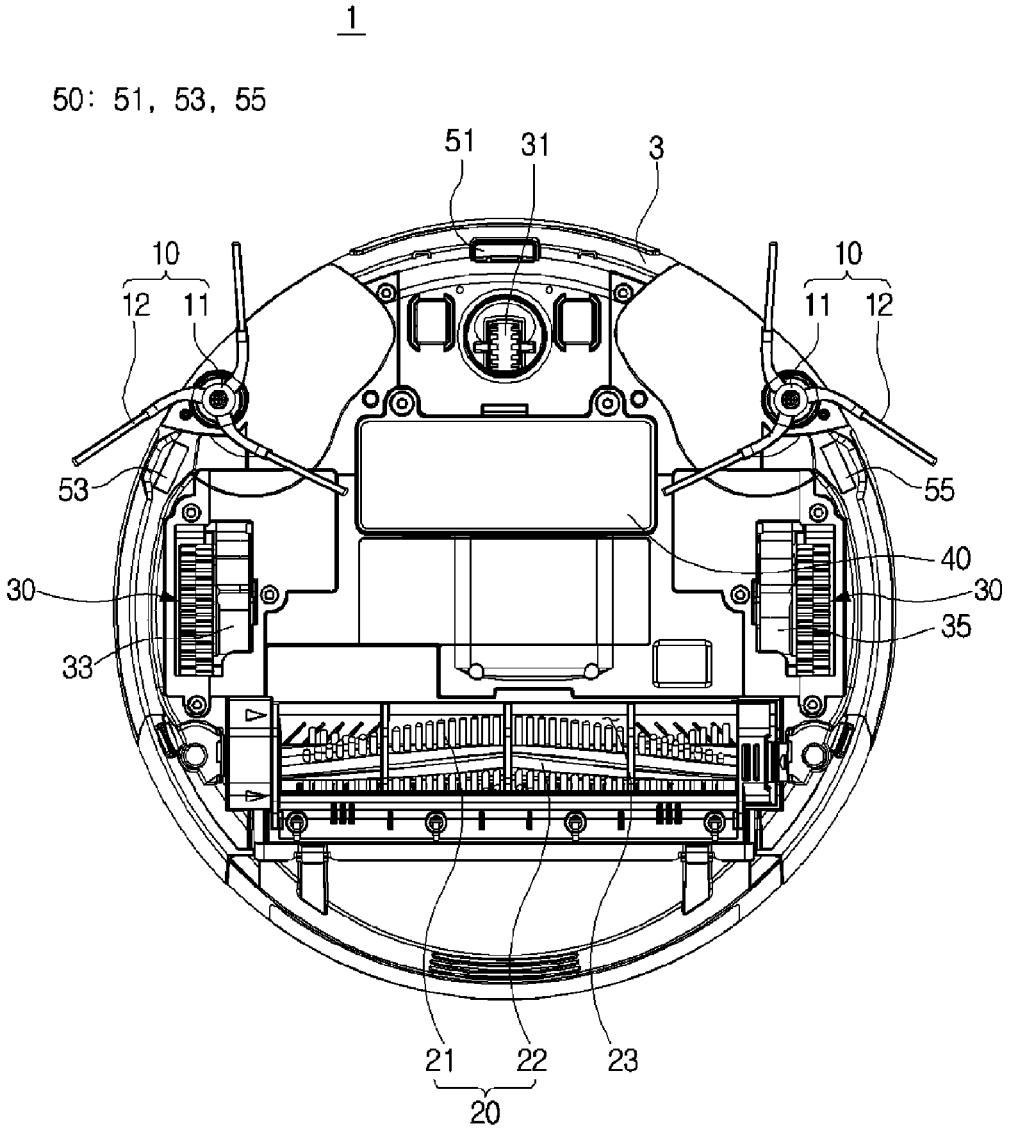
FIG. 2 is a bottom view of a robot cleaner, in accordance with an embodiment of the present disclosure.
Figure 3A:
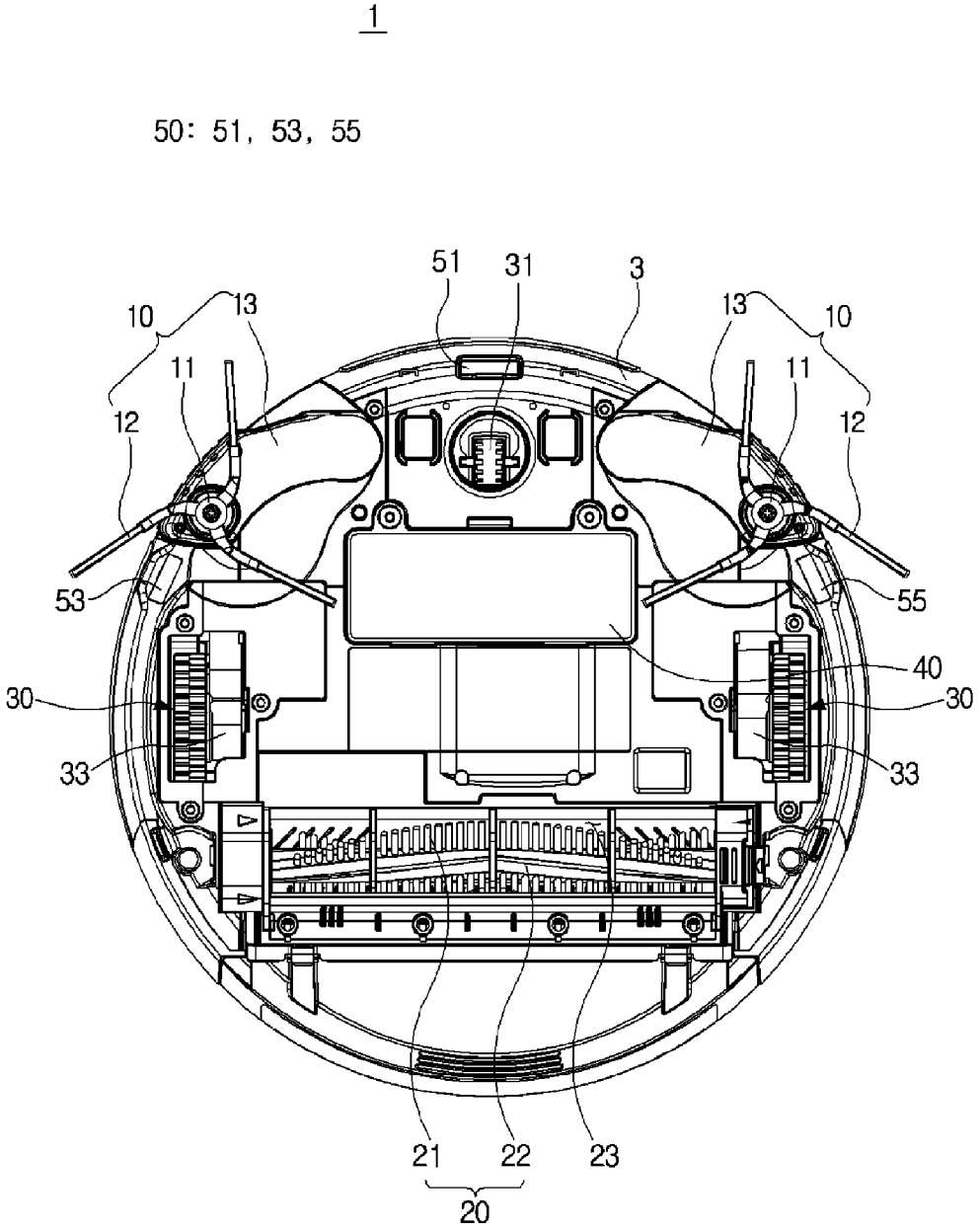
FIGS. 3A and 3B are bottom views of a robot cleaner, in accordance with another embodiment of the present disclosure.
Figure 3B:
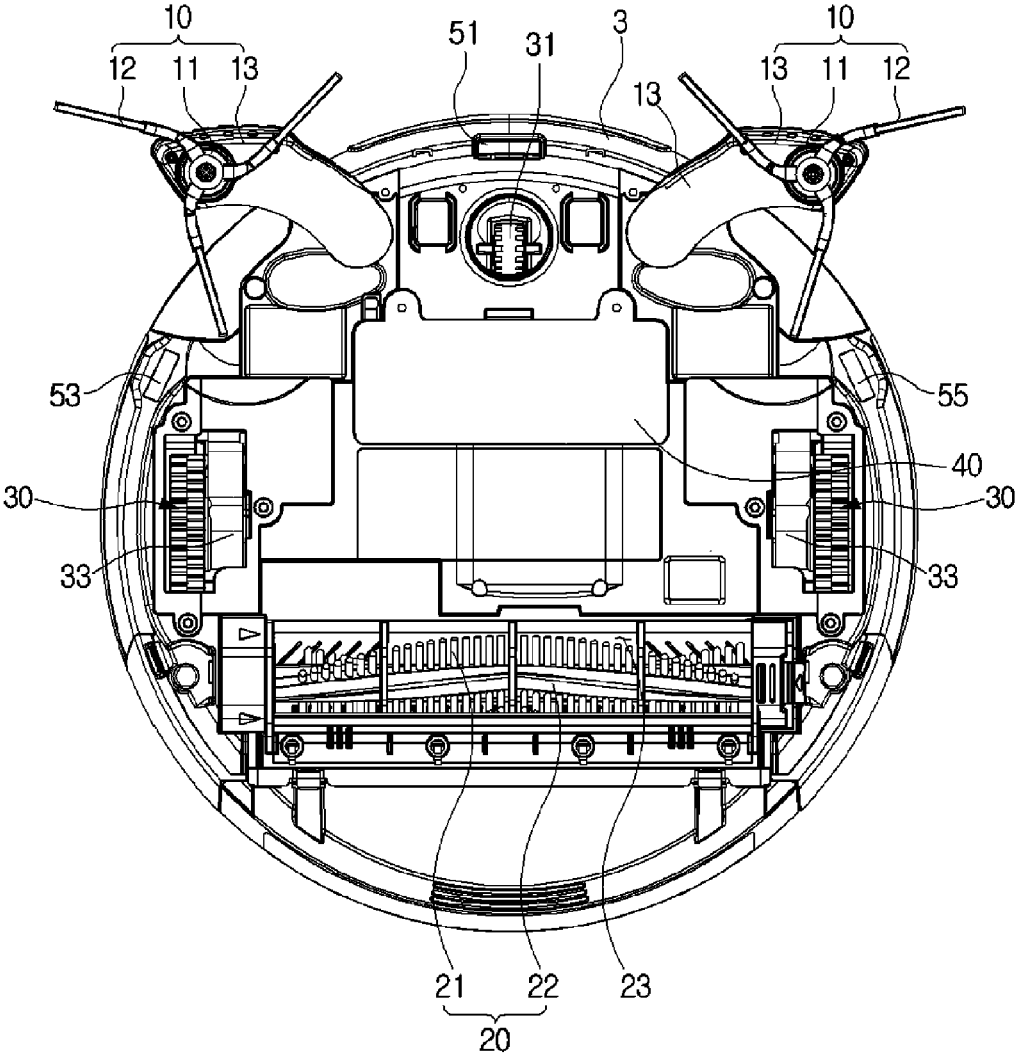

FIG. 1 is a perspective view of a robot cleaner, in accordance with an embodiment of the present disclosure; FIG. 2 is a bottom view of a robot cleaner, in accordance with an embodiment of the present disclosure; FIGS. 3A and 3B are bottom views of a robot cleaner, in accordance with another embodiment of the present disclosure.

As shown in FIGS. 1 and 2, a robot cleaner 1 may include a main body 2, a drive wheel assembly 30, a main brush unit 20, a side brush assembly 10, a power unit 40, a dust collector 7, a vision sensor 4, a communication unit 5, and a display unit 6.

The power unit 40 supplies driving power for driving the robot cleaner 1. The power unit 40 may include a battery coupled electrically with various driving units for driving the main body 2 and various parts equipped in the main body 2 to supply them with driving power. The battery may be a secondary rechargeable battery, which may be recharged with power supplied from a docking station (not shown). The docking station is a device into which the robot cleaner 1 docks after completing a vacuuming procedure or if an amount of charge remaining in the battery is less than a threshold, such as a predetermined threshold, and the docking station may supply power to the robot cleaner 1 from an external or internal power source.

The power unit 40 may be equipped on the bottom of the main body 2 as shown in FIG. 2, FIGS. 3A and 3B.

The communication unit 5 may be equipped in an upper front part of the main body 2, allowing the main body 2 to communicate with external devices, such as the docking station, a virtual guard, a remote controller, a terminal, etc.

The communication unit 5 may send information regarding whether vacuuming has been completed, an amount of charge remaining in the battery installed within the main body 2, a position of the main body 2, etc., and may receive a position of the docking station and a docking signal to guide docking of the robot cleaner 1 into the docking station.

The communication unit 5 may also communicate entrance restriction signals with the virtual guard that forms a virtual barrier. The virtual guard forms the virtual barrier by sending a signal restricting entrance to a passage that connects the current vacuuming area and a particular area, and the communication unit 5 may block the robot cleaner 1 from entering the particular area by receiving the entrance restriction signal.

The communication unit 5 may receive a command input by a user with a remote controller or an external terminal. For example, the user may input commands to start/stop vacuuming, to move the robot cleaner 1, etc., with the remote controller, and the communication unit 5 may receive the user command from the remote controller and enable the robot cleaner 1 to perform operations accordingly.

The drive wheel assembly 30 may be multiple in number, and in this regard, as shown in FIG. 2, two drive wheel assemblies 30 may be arranged on left and right edges of the main body 2 symmetrically from the bottom center. The drive wheel assembly 30 includes drive wheels 33 and 35 that enable running motions, such as forward, backward, and circular motions in the vacuuming procedure. The drive wheel assembly 30 may be detachably mounted on the bottom of the main body 2 in a modular form. Accordingly, if the drive wheels 33 and 35 have a problem in need of repair, only the drive wheel assembly 30 needs to be removed from the bottom of the main body 2 to be fixed without need to take apart the entire main body 2. The drive wheel assembly 30 may be mounted on the bottom of the main body 2 by means of hook combination, screw combination, snap-in, etc.

A caster 31 is formed on a front edge of the main body 2 apart from the bottom center, to help stabilize the main body 2. The caster 31 may constitute an assembly like the drive wheel assembly 30.

The main brush unit 20 is equipped on the side of an intake 23 arranged on the bottom of the main body 2. The main brush unit 20 may include a main brush 21 and a roller 22. The main brush 21 attached on the exterior of the roller 22 swirls and draws dirt on the floor surface as the roller 22 rotates. The main brush 21 may be made of any substance having elasticity. The roller 22 may be made of a rigid member.

Although not shown in the Figures, a fan may be arranged inside the intake 23 to generate a suction force, moving dirt drawn into the intake 23 to the dust collector 7.

The side brush assembly 10 may be detachably equipped on the bottom of the main body 2 in a modular form. Accordingly, if the side brush assembly 10 has a problem in need of repair, only the side brush assembly 10 needs to be removed from the bottom of the main body 2 to be fixed without need to take apart the entire main body 2. The side brush assembly 10 may be equipped on the bottom of the main body 2 in various ways, such as hook combination, screw combination, snap-in, etc. While two side brush assemblies 10 are equipped on the left and right edges of the caster 2 in the embodiment of FIG. 2, two or more side brush assemblies 10 may be equipped some distance apart from each other on the bottom of the main body 2 in other embodiments. There is no limitation on the quantity of side brush assemblies 10 that may be used.

The side brush assembly 10 may include a rotation shaft 11 and a side brush 12. As the rotation shaft 11 rotates, the side brush 12 may rotate around and along the rotation shaft 11. The side brush 12 may rotate and sweep the dirt on the floor surface in the running path of the robot cleaner 1 toward the intake 23.

The side brush assembly 10 may constitute a protruding side brush assembly 10 by further including a side arm 13, as shown in FIGS. 3A and 3B. Specifically, the side arm 131 may be equipped in the main body 2 to be able to rotate to a certain angle, and the rotation shaft 11 and side brush 12 may be attached to the side arm 13 to be able to extend from or return to the main body 2 as the side arm 13 rotates.

The dust collector 7 may be equipped in the rear part of the main body 2 for collecting and filtering dirt guided to the intake 23 through the main brush unit 20 and the side brush assembly 10.

Various sensors may be equipped in the main body 2. The sensors may include at least one of a vision sensor 4, an obstacle detection sensor 90, a floor detection sensor 50, and an acceleration sensor (or tilt sensor) 70 (of FIG. 4).

The vision sensor 4 refers to a sensor for recognizing a position of the robot cleaner 1 and making a map allowing the robot cleaner 1 to navigate. The vision sensor 4 may be implemented as a device for obtaining image data, such as a camera, and may be arranged on the top of the main body 2. Specifically, the vision sensor 4 may extract features from the image data of an image above the robot cleaner 1, recognize a position of the robot cleaner 1 using the features, generate a map of a vacuuming area, and even enable a current position of the robot cleaner 1 to be determined on the map.

The obstacle detection sensor 90 is a sensor for mainly detecting obstacles (e.g., household goods, furniture, walls, wall corners, etc.), which may be in the form of an ultrasonic sensor for recognizing a distance, but is not limited thereto.

The obstacle detection sensor 90 may be multiple in number, which are arranged on the front and side parts around the main body 2, and a sensor window is prepared in front of the multiple obstacle detection sensors 90 to protect and shield the sensors against the outside world.

The floor detection sensor 50 refers to a sensor for detecting a distance of the robot cleaner 1 from the floor surface and detecting conditions of the floor surface, such as presence/absence of a cliff, precipice, or a doorsill. There may be at least one floor detection sensor 50 arranged on the bottom of the main body 2. For example, the floor surface detection sensor 50 may include a first floor detection sensor 51 arranged on the bottom front of the main body 2 and two second floor detection sensors 53 and 55 arranged on the front of the two drive wheel assemblies 30 of the main body 2, respectively, as shown in FIGS. 2, 3A, and 3B. The first floor detection sensor 51 may detect a distance between the floor surface and the bottom of the main body 2 at the front, and the second floor detection sensors 53 and 55 may each detect a distance between the floor surface and the bottom of the main body 2 at a corresponding side.

The tilt sensor 70 is a sensor for measuring tilt degrees of the robot cleaner 1, which may be equipped outside or inside of the main body 2. Detailed description about the obstacle detection sensor 90, floor detection sensor 50, and a tilt sensor 70 will be described later.

The display unit 6 may be equipped on the top of the main body 2. The display unit 6 may display various conditions of the robot cleaner 1. For example, a battery charging condition, whether the dust collector 7 has become full, vacuuming mode of the robot cleaner 1, sleep mode, etc., may be displayed.

Schematic external and internal structure of the robot cleaner 1 has thus far been described briefly. In the following description, configuration of the robot cleaner 1 for detecting and climbing over a protruding part that protrudes from the floor surface such as a doorsill will be explained in detail. The configuration of the robot cleaner 1 may be applied not only to the doorsill but also to any protruding parts that protrude or project from the floor surface with a similar height and width to that of a doorsill.

Figure 4:
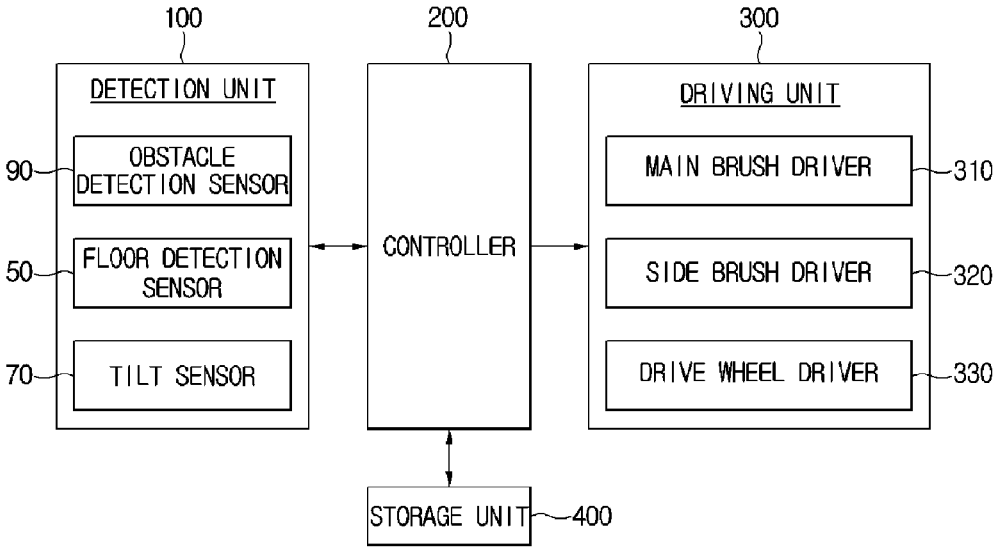
FIG. 4 is a block diagram of a robot cleaner, in accordance with an embodiment of the present disclosure.

FIG. 4 is a block diagram of a robot cleaner, in accordance with an embodiment of the present disclosure.

Referring to FIG. 4, the robot cleaner 1 may include a detection unit 100 for detecting conditions of the floor surface, a controller 200 for determining whether there is a doorsill on the floor surface, a driving unit 300 for moving the robot cleaner 1, and a storage unit 400 for storing data or algorithms.

The detection unit 100 may include the obstacle detection sensor 90, the floor detection sensor 50, and the tilt sensor 70 to detect an obstacle and conditions of the floor surface in the running path of the robot cleaner 1.

Multiple obstacle detection sensors 90 may be installed on the outer circumference of the main body 2, and more particularly, installed on the front and side parts of the main body 2 at certain intervals, for detecting obstacles present in front of or on the sides of the robot cleaner 1 and sending information about the detection to the controller 200.

The obstacle detection sensor 90 may include a contact sensor or non-contact sensor depending on whether it contacts the obstacle, or may include both of them. The term contact sensor refers to a sensor that detects an obstacle when the main body 2 collides against the obstacle, and the term non-contact sensor refers to a sensor that detects an obstacle in advance before the main body 2 collides with the obstacle or without collision between the main body 2 and the obstacle.

The non-contact sensor may include an ultrasonic sensor, optical sensor, Radio Frequency (RF) sensor, or the like. In case the obstacle detection sensor 90 is implemented with an ultrasonic sensor, it may detect an obstacle by transmitting ultrasound waves into the running path and receiving reflected ultrasound waves. In case the obstacle detection sensor 90 is implemented with an optical sensor, it may detect an obstacle by transmitting optical signals, such as infrared (IR) signals or ultraviolet (UV) signals into the running path and receiving reflected optical signals. On the other hand, in case the obstacle detection sensor 90 is implemented with an RF sensor, it may detect an obstacle by using a Doppler effect to transmit a wave of a particular frequency, e.g., a microwave and detect a change in frequency of a reflected wave.

The floor detection sensor 50 may be arranged as an optical sensor on the bottom of the main body 2 in various forms and may detect a distance of the robot cleaner 1 from the floor surface, or a distance between the floor surface and the bottom of the main body 2. For example, the floor detection sensor 50 may be implemented as an infrared (IR) sensor that uses an IR area, to emit IR rays toward the floor and detect the distance from the floor surface based on reflected IR rays. In case there are multiple floor detection sensors 50, the multiple floor detection sensors 50 may be of the same kind (e.g., IR sensors) or may include different types of sensors.

The floor detection sensor 50 may output a sensor value that corresponds to the detected distance to the controller 200, wherein the range of the sensor value may depend on a brightness or reflectivity of the floor surface. Especially, the range of the sensor value for a bright floor surface includes the range of the sensor value for a dark floor surface, thus being wider than that for the dark floor surface. The sensor value of the floor detection sensor 50 that corresponds to the detected distance will be explained with reference to FIGS. 5A to 5C.

Figure 5A:
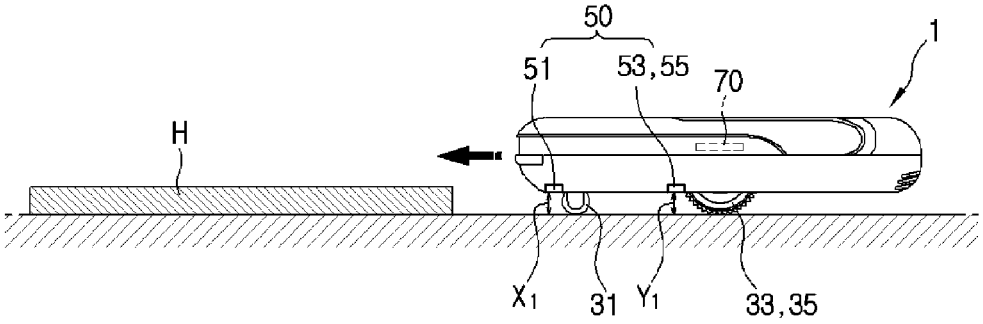
FIGS. 5A, 5B, and 5C illustrate an occasion where there is a doorsill in a running path of a robot cleaner.
Figure 5B:
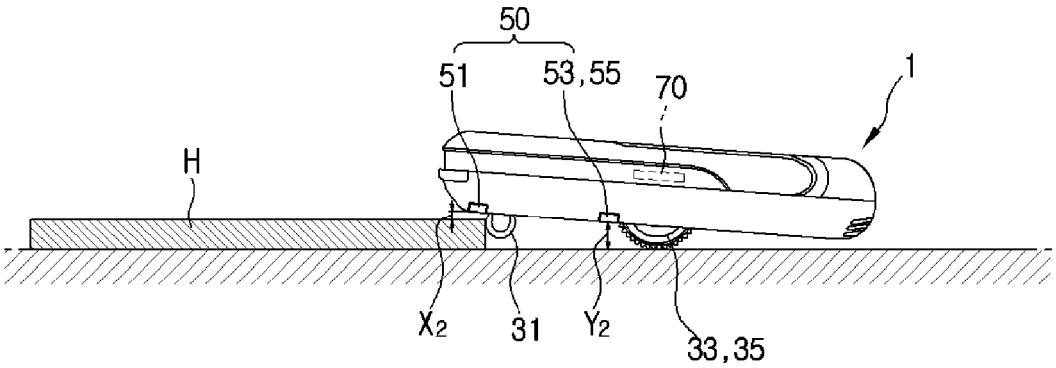
Figure 5C:
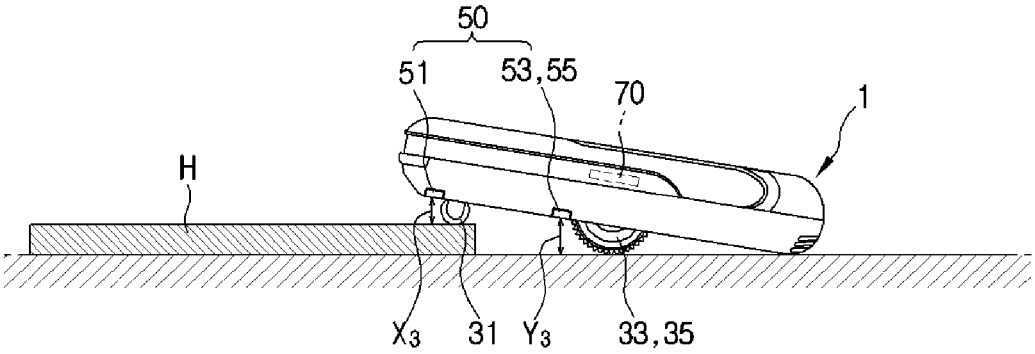

FIGS. 5A, 5B, and 5C illustrate an occasion where there is a doorsill in a running path of a robot cleaner. In FIGS. 5A to 5C, a side view of the robot cleaner 1 shown in FIGS. 1 to 3B is illustrated.

The floor detection sensor 50 of the robot cleaner 1 may be comprised of the first floor detection sensor 51 for detecting a distance from the floor surface at the front part and two second floor detection sensors 53 and 55 for detecting distances from the floor surface at both sides.

As shown in FIG. 5A, if there is a doorsill H in front of the robot cleaner 1, the distance to the floor surface detected by the first floor detection sensor 51 is constant X1 and the distance to the floor surface detected by the second floor detection sensor 52 is constant Y1. With the relation of X1=Y1, the sensor value output from the first floor detection sensor 51 to the controller 200 is the same as the sensor value output from each of the second floor detection sensors 53 and 55 to the controller 200.

FIG. 5B illustrates an occasion where the robot cleaner 1 advances with the front part of the caster 31 resting on the doorsill H. Since the first floor detection sensor 51 is located on or near the top of doorsill H, a distance to the floor surface, X2, refers to a distance from the bottom of the main body 2 to the top of the doorsill H, which becomes relatively small compared to X1 of FIG. 5A. As the robot cleaner 1 becomes inclined to one side, the distance to the floor surface that is detected by each of the second floor detection sensors 53 and 55, Y2, becomes relatively great compared to Y1 of FIG. 5A.

That is, X2<X1 and Y1<Y2; and the sensor value output by the first floor detection sensor 51 becomes smaller than in FIG. 5A and the sensor value output by each of the second floor detection sensors 53 and 55 becomes greater than in FIG. 5A. As a result, X2<Y2, and the second floor detection sensors 53 and 55 may each output a greater sensor value than the first detection sensor 51 may output.

FIG. 5C illustrates an occasion where the caster 31 of the robot cleaner 1 rests on a doorsill H. Likewise, as in FIG. 5B, since the first floor detection sensor 51 is located on the top of the doorsill H, a distance to the floor surface, X3 refers to a distance from the bottom of the main body 2 to the top of the doorsill H. As a result, X3<Y3, and the second floor detection sensors 53 and 55 may each output a greater sensor value than the first detection sensor 51 may do.

As the caster 31 rests on the doorsill, the inclination of the robot cleaner 1 increases more than that in FIG. 5B and thus the distance to the floor surface, X3, detected by the first floor detection sensor 51 and the distance to the floor surface, Y2, detected by the second floor detection sensor have greater values than X2 and Y2 of FIG. 5B, respectively. That is, X2<X3 and Y2<Y3; and the sensor value output by the first floor detection sensor 51 becomes smaller than in FIG. 5A and the sensor value output by each of the second floor detection sensors 53 and 55 becomes greater than in FIG. 5A.

As described above, while the robot cleaner 1 is moving around, sensor values output by the floor detection sensor 50 depend on height from the floor surface or whether there is a doorsill, and sensor values of the multiple floor detection sensors 50 may be different from each other.

Figure 6:
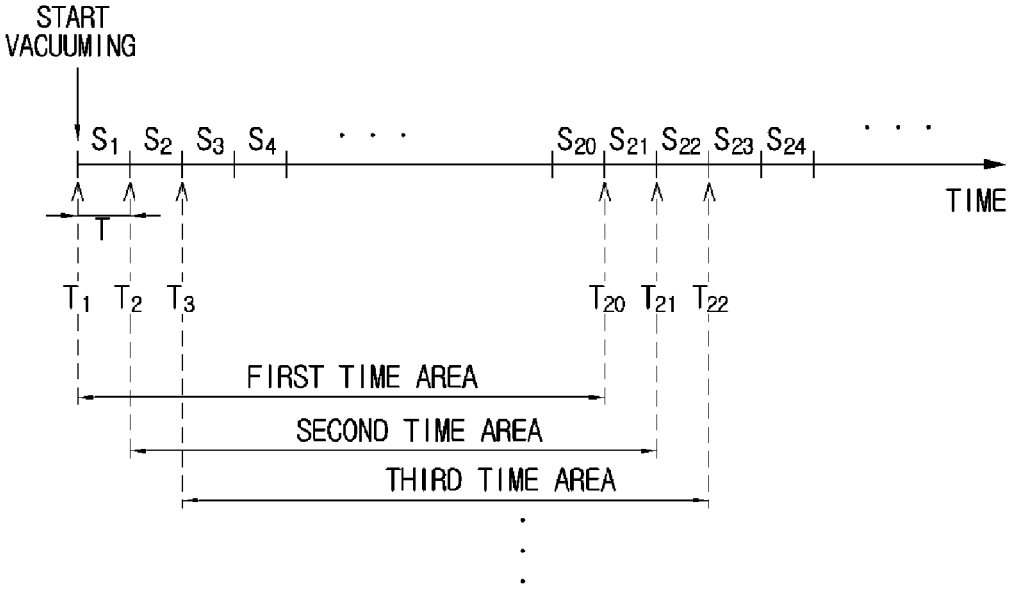
FIG. 6 illustrates sensor values output by a floor detection sensor at certain intervals.

The floor detection sensor 50 detects the distance to the floor surface and outputs a sensor value, at certain intervals while the robot cleaner 1 is moving around. FIG. 6 illustrates sensor values output by the floor detection sensor at certain intervals.

The floor detection sensor 50 detects the distance to the floor surface at intervals of T from a starting point of vacuuming until the end of the vacuuming. For example, the floor detection sensor 50 may detect the distance to the floor surface for the first time at T0 point in time, detect the distance for the second time at T1, which is T after T0, detect the distance for the third time at T2, T after T1, and so on.

The floor detection sensor 50 outputs a sensor value corresponding to a detected distance, wherein S1, S2, S3, . . . , and Sn (n is integer, n≥1) represent first, second, third, . . . , and $n^{th}$ sensor values.

Meanwhile, a vacuuming period of the robot cleaner 1 may be divided by the certain time T into multiple sections from the starting point to the end point of the vacuuming, and the multiple sections may be classified into new time areas. As shown in FIG. 6, an $m^{th}$ time area may be defined to include a predetermined number of sections starting from $m^{th}$ section among the multiple sections. For example, a first time area may be defined to have the first to 20th sections; a second time area may be defined to have the second to 21st sections; and a third time area may be defined to have the third to 22nd sections.

Sensor values Sn output in the multiple sections or sensor values output in the newly classified time areas, and respective maximum and minimum values of the sections or the time areas may be stored in the storage unit 400, and the controller 200 may use these values to determine whether there is a doorsill. This will be described in more detail later.

The tilt sensor 70 may include at least one of a tilt switch, an acceleration sensor, and a gyro sensor to measure an inclination angle of the robot cleaner 1, i.e., tilting degrees of the main body 2 from the floor surface. The tilt switch refers to a switch that becomes 'On' when the inclination angle is equal to or greater than a certain threshold such as a predetermined threshold while becoming 'Off' when the inclination angle is less than the certain threshold; the acceleration sensor refers to a sensor for detecting a change in moving speed of the main body 2 and gravitational acceleration working on the main body 2; and the gyro sensor refers to a sensor for detecting a rotational direction and rotation angle according to a motion of the main body 2. A method for measuring the inclination by means of the tilt switch, acceleration sensor or gyro sensor is well known to one skilled in the art and thus the detailed description of the method will be omitted herein.

Turning back to FIGS. 5A to 5C, the tilt sensor 70 is illustrated as being equipped inside of the main body 2, but the tilt sensor 70 may be equipped outside of the main body 2, such as on the top or bottom face of the main body 2. As the inclination of the main body 2 against a level surface increases while the position of the robot cleaner 1 in FIG. 5A changes to the positions of FIG. 5B through FIG. 5C, the measurement of the tilt sensor 70 measured under the situation of FIG. 5C may reach a maximum value. The measurement of the tilt sensor 70 is sent to the controller 200, which in turn uses the measurement to determine whether there is a doorsill.

The controller 200 may determine whether there are obstacles in the running path of the robot cleaner 1 and whether there are cliffs, doorsills, or similar obstacles on the floor.

First, the controller 200 may determine whether there are obstacles and where the obstacles are based on values output from the obstacle detection sensor 90.

For example, when the obstacle detection sensor 90 is implemented with an ultrasonic sensor, the controller 200 may determine whether there is an obstacle based on whether reflected ultrasound waves are received or based on receive strength of the reflected ultrasound waves, and may detect a distance between the main body 2 and the obstacle based on the relative receive strength of the reflected ultrasound waves to transmit ultrasound waves or received time of the reflected ultrasound waves.

In another example, when the obstacle detection sensor 90 is implemented with an optical sensor, the controller 200 may determine whether there is an obstacle based on whether reflected light is received or based on receive strength of the reflected light, and may detect a distance between the main body 2 and the obstacle based on the relative receive strength of the reflected light to emitted light or received time of the reflected light.

In yet another example, when the obstacle detection sensor 90 is implemented with an RF sensor, the controller 200 may determine whether there is an obstacle, whether there is a motion of the obstacle, and determine a moving direction and speed of the obstacle based on a detected change in frequencies.

The controller 200 may determine whether there is a cliff based on a sensor value of the floor detection sensor 50 and whether there is a doorsill based on measurements of the floor detection sensor 50 and the tilt sensor 70. How to determine whether there is a cliff based on the sensor value of the floor detection sensor 50 is known, and thus the detailed description of the method will be omitted herein.

The controller 200 may initially determine whether there is a doorsill based on the sensor value of the floor detection sensor 50.

First, the controller 200 may extract respective maximum and minimum values for respective newly classified time areas by comparing sensor values output by the floor detection sensor 50. If there are multiple floor detection sensors 50, maximum and minimum values may be extracted from the sensor values output by a predetermined sensor, e.g., the first floor detection sensor 51 located on the front. Specifically, turning back to FIG. 6, for the first time area with sensor values S1 to S20 output by the floor detection sensor 50, the controller 200 may compare magnitudes of S1 to S20 and extract a maximum value and a minimum value among them. For the second time area with sensor values S2 to S21 output by the floor detection sensor 50, the controller 200 may compare magnitudes of S2 to S21 and extract a maximum value and a minimum value among them. In this way, the controller 200 may extract a maximum value and a minimum value in an $m^{th}$ time area (m is natural number, m≥1).

The controller 200 may determine whether a difference between the extracted maximum value and minimum value exceeds a threshold for determination about a drop, and may determine that there is a cliff if the difference exceeds the threshold. The threshold for determination about the drop may be referred to as a drop determination value and stored in the storage unit 400 beforehand.

If the difference between the extracted maximum value and minimum value is less than the drop determination value, the controller 200 may determine whether the difference exceeds a threshold for a determination about a doorsill and may recognize that there is a doorsill if the difference exceeds the threshold for determination about the doorsill. The threshold for determination about the doorsill may be referred to as a first doorsill determination value. The first doorsill determination value may be preset to be less than the drop determination value and stored in the storage unit 400.

The controller 200 may sequentially compare the difference between the maximum and minimum values with the drop determination value and the first doorsill determination value, and to determine that there is a doorsill in the time area if the difference is less than the drop determination value but exceeds the first doorsill determination value.

In the meantime, the drop determination value and the first doorsill determination value may include a plurality of values depending on whether the floor surface is bright or dark, or depending on a reflectivity of the floor surface. As described above, the range of the sensor value for a bright floor surface contains the range of the sensor value for a dark floor surface, thus being wider than that for the dark floor surface. Accordingly, provided that drop determination values for bright floor surface and dark floor surface are E11 and E12, respectively, the drop determination value E11 may be set to be greater than the drop determination value E12. Likewise, provided that first doorsill determination values for bright floor surface and dark floor surface are D11 and D12, respectively, the first doorsill determination value D11 may be set to be greater than the first doorsill determination value D12. Of course, for the floor surface with the same brightness level, the drop determination value is set to be greater than the first doorsill determination value.

If the drop determination value and the first doorsill determination value are set differently depending on the brightness level, i.e., whether the floor surface is bright or dark, the controller 200 may determine whether the floor surface is bright or dark first and then may use the drop determination value and the first doorsill determination value set for the brightness level to determine a difference between maximum and minimum values for each time area.

Specifically, provided that a threshold for determining the brightness level, i.e., a brightness determination value is predefined and stored in the storage unit 400, the controller 200 may determine whether the extracted maximum value exceeds the brightness determination value and recognize that the brightness level is high (bright) if the maximum value exceeds the brightness determination value and recognize that the brightness level is low (dark) if the maximum value does not exceed the brightness determination value. If recognizing the floor surface is bright, the controller 200 may sequentially determine whether the difference between the maximum and minimum values exceeds the drop determination value E11 and whether the difference exceeds the first doorsill determination value D11. If recognizing the floor surface is dark, the controller 200 may sequentially determine whether the difference between the maximum and minimum values exceeds the drop determination value E12 and whether the difference exceeds the first doorsill determination value D12.

The controller 200 may finally determine whether there is a doorsill based on the measurement of the tilt sensor 70. In other words, having initially recognized a doorsill, the controller 200 may determine whether a measurement of the tilt sensor 70 exceeds a predetermined threshold and finally recognize that there is a doorsill if the measurement exceeds the predetermined threshold. The predetermined threshold may be referred to as a second doorsill determination value, which may be stored in the storage unit 400 beforehand.

For example, having initially recognized that there is a doorsill in the second time area, the controller 200 may determine whether a measurement sent from the second tilt sensor 70 exceeds the second doorsill determination value. If the measurement exceeds the second doorsill determination value, the controller 200 finally recognizes that there is a doorsill. Otherwise, if the measurement does not exceed the second doorsill determination value, the controller 200 recognizes that there is no doorsill and then start again to make an initial decision for the next time area, i.e., the third time area.

In the final determination, the controller 200 may use a plurality of measurements output from the tilt sensor 70. Specifically, if all the consecutive measurements output from the tilt sensor 70 for a predetermined time exceed the second doorsill determination value, the controller 200 may finally recognize that there is a doorsill in the time area.

The controller 200 may determine moving operations of the robot cleaner 1 according to not only the presence or absence, position, and type of an obstacle, but also based on the presence or absence of a cliff or doorsill. For example, if there is a cliff in the running path of the robot cleaner 1, the controller 200 may determine moving operations of the robot cleaner 1 to allow the robot cleaner 1 to detour the cliff. In another example, if there is an obstacle in the running path of the robot cleaner 1, the controller 200 may determine moving operations of the robot cleaner 1 to detour the obstacle. Especially, if the obstacle is located to the left or right of the doorsill, the controller 200 may determine the running pattern of the robot cleaner 1 depending on the location of the obstacle. The manner used to detour a cliff or an obstacle may follow the well-known method, and a method for determining the running pattern of the robot cleaner 1 based on whether an obstacle is located to the left or right of the doorsill will be described below in conjunction with the driving unit 300.

The driving unit 300 may include a drive wheel driver 330 for controlling the drive wheels 33 and 35, a main brush driver 310 for controlling the main brush 21, and a side brush driver 320 for controlling the side brush 12, based on determination of the controller 200.

The drive wheel driver 330 may be included in the drive wheel assembly 30, and may constitute a module with the drive wheel assembly 30. The drive wheel driver 330 controls the drive wheels 33 and 35 mounted on the bottom of the main body 2 to move the robot cleaner 1, under the control of the controller 200. Especially, if the controller 200 has finally recognized that there is a doorsill, the drive wheel driver 330 controls the drive wheels 33 and 35 to make the robot cleaner 1 climb over the doorsill. Climbing over the doorsill under control of the drive wheel driver 300 will be described in more detail with reference to FIGS. 7A to 8B.

Figure 7A:
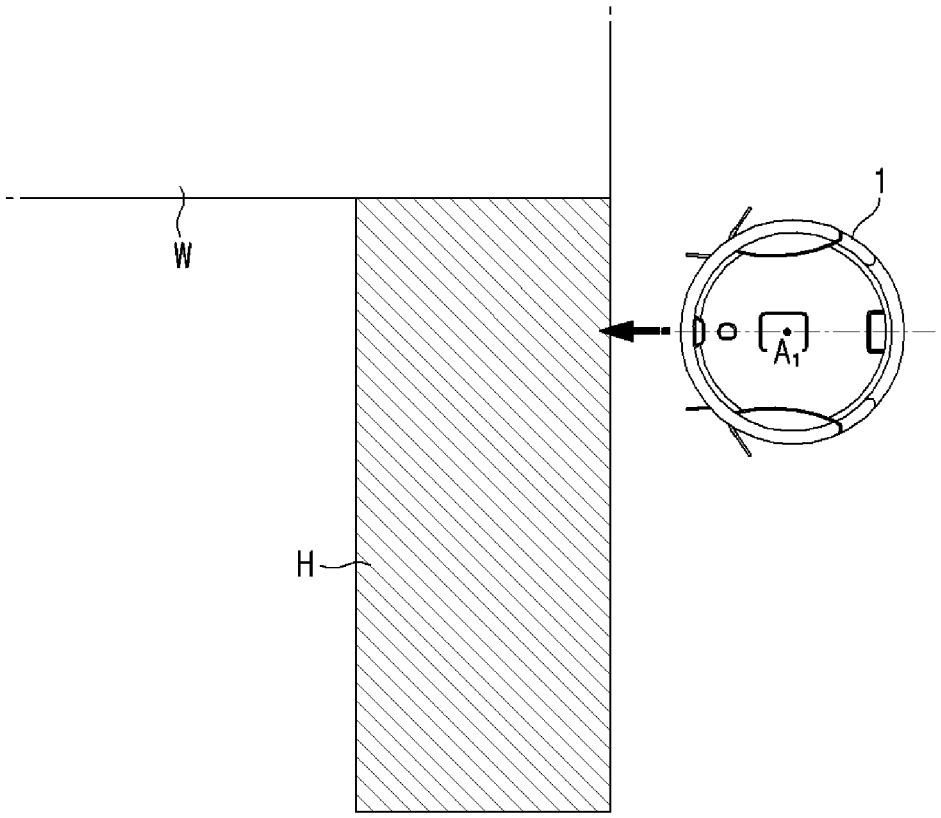
FIGS. 7A, 7B, 7C, 7D, and 7E illustrate a procedure of a robot cleaner climbing over a doorsill.
Figure 7B:
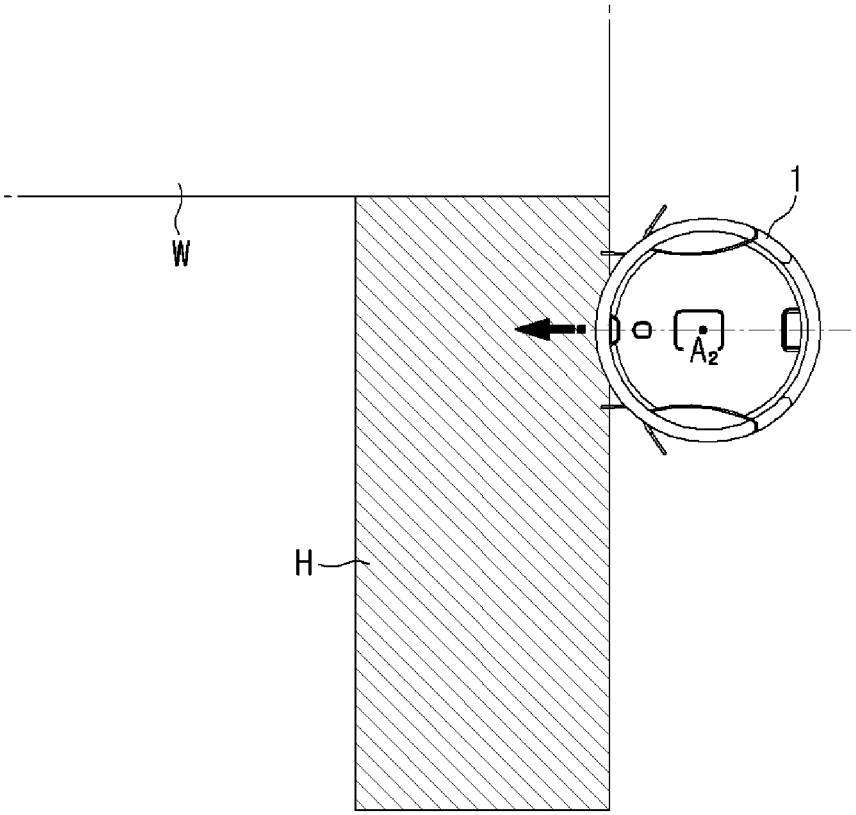

FIGS. 7A to 7E illustrate a procedure the robot cleaner 1 uses to climb over a doorsill. Specifically, FIG. 7A illustrates a plane view of the robot cleaner 1 shown in FIG. 5A, and FIG. 7B illustrates a plane view of the robot cleaner 1 shown in FIG. 5B or 5C. Assume that a doorsill H is located in the running path of the robot cleaner 1 and an obstacle W like a wall is located to the right of the doorsill H. The obstacle W being located to the right of the robot cleaner 1 means that the obstacle W is located only to the right of the robot cleaner 1 or that the obstacle W to the right is closer to the robot cleaner 1 than an obstacle to the left is. If the obstacle W is located to the left of the robot cleaner 1, it means the other way around.

The drive wheel driver 330 may control the drive wheels 33 and 35 to move the robot cleaner 1 in the predetermined running direction and running pattern set for the vacuuming area, as shown in FIG. 7A.

While the robot cleaner 1 is moving around, the controller 200 may consecutively determine whether there is a doorsill based on a sensor value of the floor detection sensor 50 and a measurement of the tilt sensor 70. As shown in FIG. 7B, when the front part of the main body 2 rests on the doorsill H, the sensor value of the floor detection sensor 50 changes due to the height of the doorsill from the floor surface, and accordingly the controller 200 may initially determine that there is a doorsill. Such an initial determination made by the controller 200 based on the sensor value of the floor detection sensor 50 was described above, and thus further detailed description will be omitted.

The drive wheel driver 330 may control the drive wheels 33 and 35 to stick to the existing running direction and running pattern. Since the front part of the main body 2 rests on the doorsill H, the main body 2 is inclined to one side and the controller 200 may finally determine from the measurement of the tilt sensor 70 that there is a doorsill. Such a final determination made by the controller 200 based on the measurement of the tilt sensor 70 was described above, and thus further detailed description will be omitted.

If it is finally determined that there is a doorsill, the drive wheel driver 330 may control the drive wheels 33 and 35 to move the robot cleaner 1 according to the running pattern in climbing over the doorsill. A basic running pattern in climbing over the doorsill may be preset as a left/right zigzag pattern or right/left zigzag pattern. The left/right zigzag pattern is a zigzag pattern to move the main body 2 to the left and then to the right, and the right/left zigzag pattern is a zigzag pattern to move the main body 2 to the right and then to the left. For convenience of explanation, assume that the basic running pattern in climbing over the doorsill is set as the left/right zigzag pattern.

The controller 200 may determine whether there is an obstacle W like a wall based on a value output from the obstacle detection sensor 200. Specifically, the controller 200 may determine whether an obstacle W is located to the left or to the right of the main body 2. If the controller 200 recognizes an obstacle W to the right, the drive wheel driver 330 may control the drive wheels 33 and 35 to move according to the basic running pattern for climbing over a doorsill. The basic running pattern herein is the left/right zigzag pattern. On the other hand, if the controller 200 recognizes an obstacle W to the left, the drive wheel driver 330 may change the set running pattern and control the drive wheels 33 and 35 to move according to the right/left zigzag pattern.

Figure 7C:
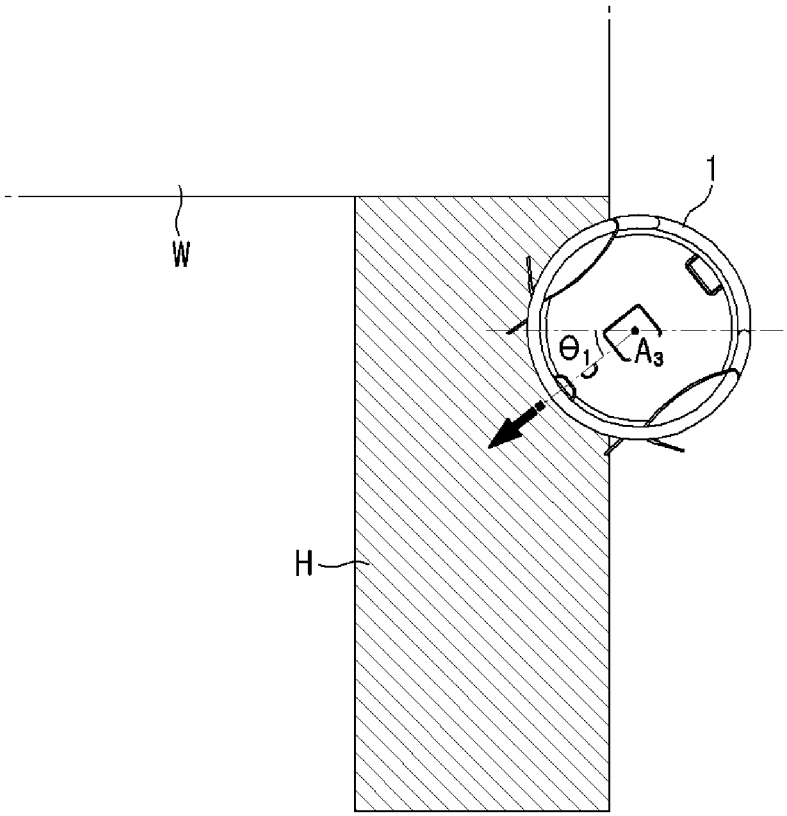
Figure 7D:
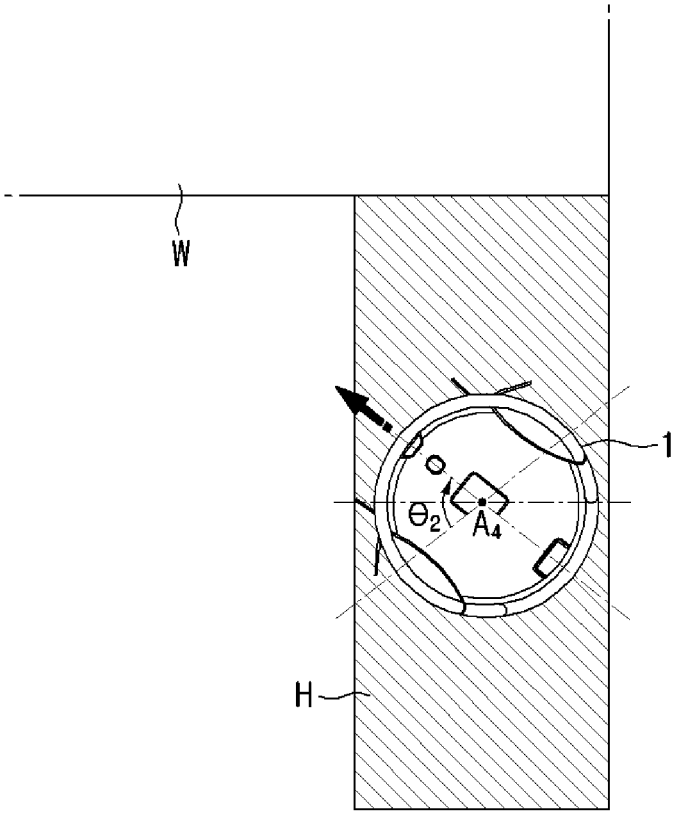

Referring to FIG. 7C where an obstacle W is located to the right, the drive wheel driver 330 may drive the drive wheels 33 and 35 to move to the left first. Specifically, the drive wheel driver 330 controls the drive wheels 33 and 35 to rotate the main body 2 to an angle of θ1° in the opposite direction of the obstacle W and move it forward at the angle of θ1°. Then, as shown in FIG. 7D, the drive wheel driver 330 controls the drive wheels 33 and 35 to move to the right. Specifically, the drive wheel driver 330 controls the drive wheels 33 and 35 to rotate the main body 2 to an angle of θ2° in the direction of the obstacle W and move it forward at the angle of θ2°. Such a left/right zigzag pattern may be repeated depending on the width of the doorsill H.

Figure 7E:
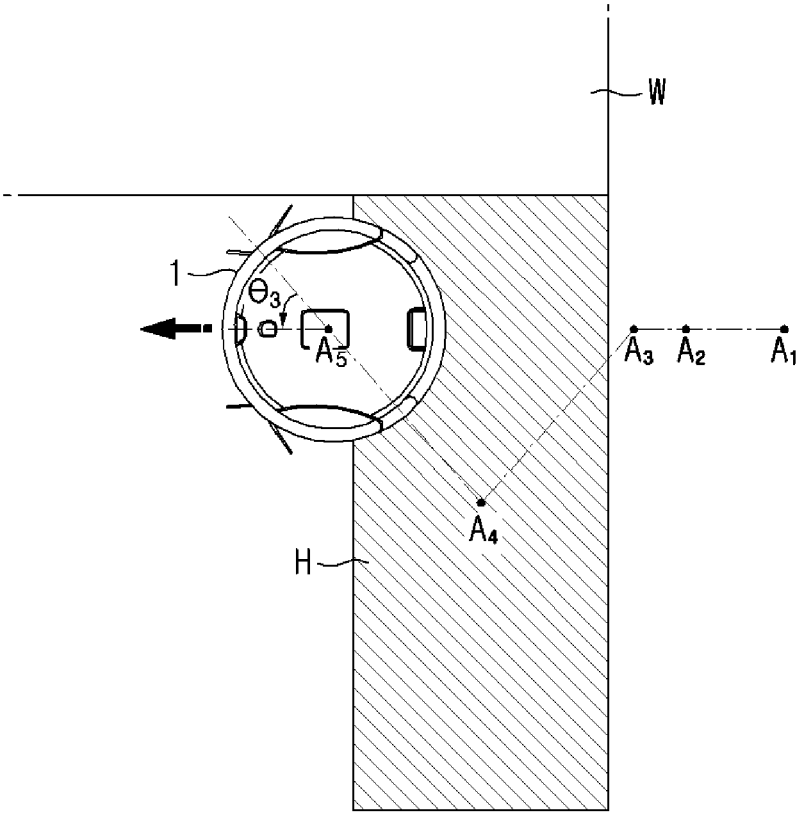

Having the main body 2 moved in the left/right zigzag pattern, the drive wheel driver 330 controls the drive wheels 33 and 35 to rotate the main body 2 to an angle of θ3° in the opposite direction of the obstacle W and move it forward at the angle of θ3°, following the existing running pattern in the existing running direction, as shown in FIG. 7E.

A1 to A5 shown in FIGS. 7A to 7E represent the movement of the center of the main body 2. The rotation angles θ1°, θ2°, and θ3° and the forward distance at the corresponding angle, i.e., a distance that main body 2 travels from A3 to A4 and from A4 to A5 are set in advance and stored in the storage unit 200.

Figure 8A:
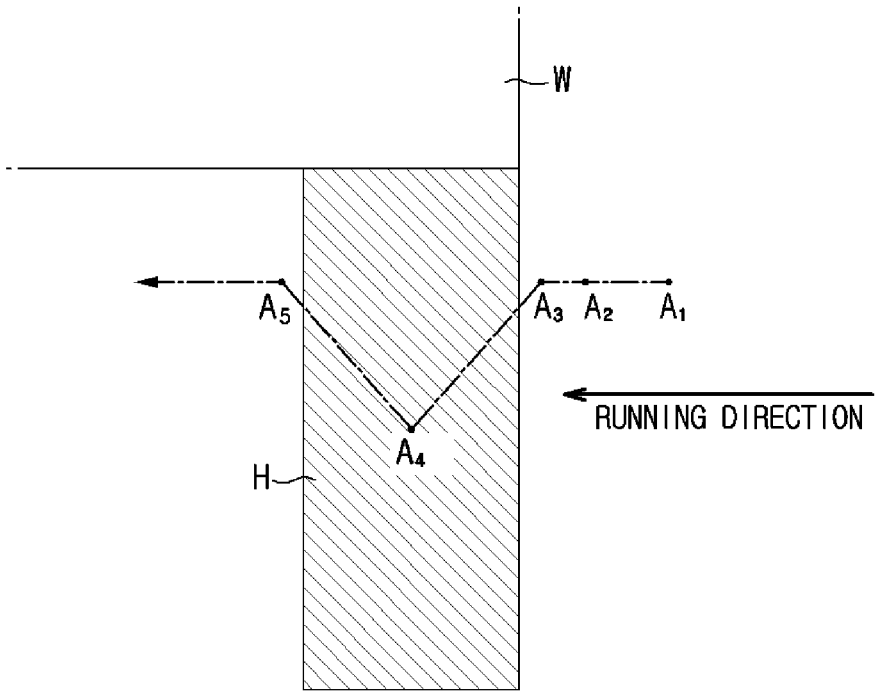
FIGS. 8A and 8B illustrate climbing patterns of a robot cleaner based on where an obstacle is.
Figure 8B:
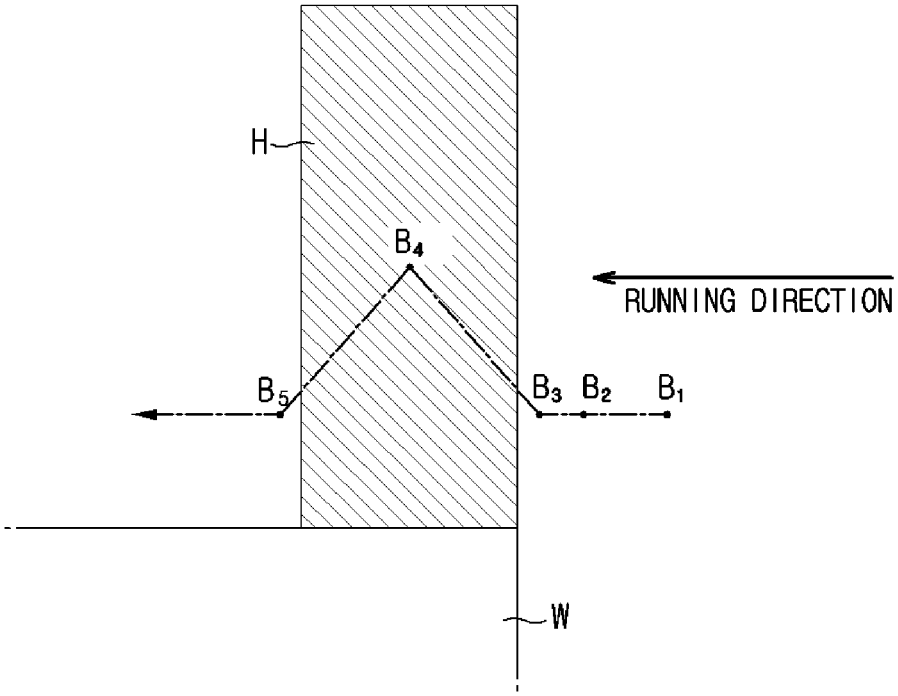

FIGS. 8A and 8B illustrate climbing patterns of the robot cleaner 1 based on positions of obstacles. FIG. 8A shows an occasion where an obstacle W is located to the right of the doorsill H and the robot cleaner 1 has climbed over the doorsill H in the left/right zigzag pattern under control of the drive wheel driver 330, as described above in connection with FIGS. 7A to 7E. FIG. 8B shows an occasion where an obstacle W is located to the left of the doorsill H and the robot cleaner 1 has climbed over the doorsill H in the right/left zigzag pattern under control of the drive wheel driver 330.

B1 to B5 shown in FIG. 8B represent the movement of the center of the main body 2 while the robot cleaner 1 is climbing over the doorsill H in the right/left zigzag pattern. Rotation angles and the forward distance at the corresponding angle, i.e., a distance that main body 2 travels from B3 to B4 and from B4 to B5 are set in advance and stored in the storage unit 200.

As described above, the running pattern of the robot cleaner 1 may be changed between the left/right and right left zigzag patterns depending on where an obstacle W is, thereby preventing the main body 2 from colliding with the obstacle W. Driving the robot cleaner 1 to climb in a zigzag pattern may prevent the robot cleaner 1 from being caught by the doorsill H and enable the robot cleaner 1 to follow the existing running pattern and direction even though the vacuuming area is divided by doorsills.

The side brush driver 320 may be included in the side brush assembly 10, and constitute a module with the side brush assembly 10. The controller 200 controls the side brush driver 320 to drive the rotation shaft 11 or the side arm 13 to rotate the side brush 12, thereby enabling the robot cleaner 1 to perform vacuuming. Especially, even while the robot cleaner 1 is climbing over a doorsill in the left/right or right/left zigzag pattern, the side brush driver 320 may generate driving signals.

The main brush driver 310 may be included in the main brush unit 20 with the main brush 21 and the roller 22. The controller 200 controls the main brush driver 310 to drive the roller 22 to rotate the main brush 21, thereby enabling the robot cleaner 1 to perform vacuuming. Especially, even while the robot cleaner 1 is climbing over a doorsill in the left/right or right/left zigzag pattern, the main brush driver 310 may generate driving signals.

The storage unit 400 may store data or algorithms for operating the robot cleaner 1.

For example, the storage unit 400 may store sensor values Sn output from multiple sections or sensor values output from the newly classified time areas, and their respective maximum and minimum values. In another example, the storage unit 400 may store thresholds for determination, particularly the drop determination value, the first doorsill determination value, the second doorsill determination value, and the brightness determination value. In yet another example, the storage unit 400 may store predefined running patterns for the vacuuming area, basic running patterns for climbing over doorsills, rotation angles depending on where an obstacle is, and forward distance at the rotation angle.

Algorithms stored in the storage unit 400 may include an algorithm to determine the presence/absence and position of an obstacle based on a value output from the obstacle detection sensor 70, an algorithm to determine the presence/absence of a cliff based on a sensor value of the floor detection sensor 50, an algorithm to determine the presence/absence of a doorsill based on a sensor value of the floor detection sensor 50 and a measurement of the tilt sensor 70, and an algorithm to drive the drive wheels 33 and 35 according to running patterns.

The storage unit 400 may be implemented with volatile memory devices, such as Read Only Memory (ROM), Programmable Read Only Memory (PROM), Erasable Programmable Read Only Memory (EPROM), and flash memory, non-volatile memory devices, such as Random Access Memory (RAM), hard disks or optical disks. However, the storage unit 400 is not limited thereto, but may be implemented in any other form known in the art.

Embodiments of configurations and parts of a robot cleaner for climbing over a doorsill have thus far been described, and a method for controlling the robot cleaner will now be described with reference to given flowcharts.

Figure 9:
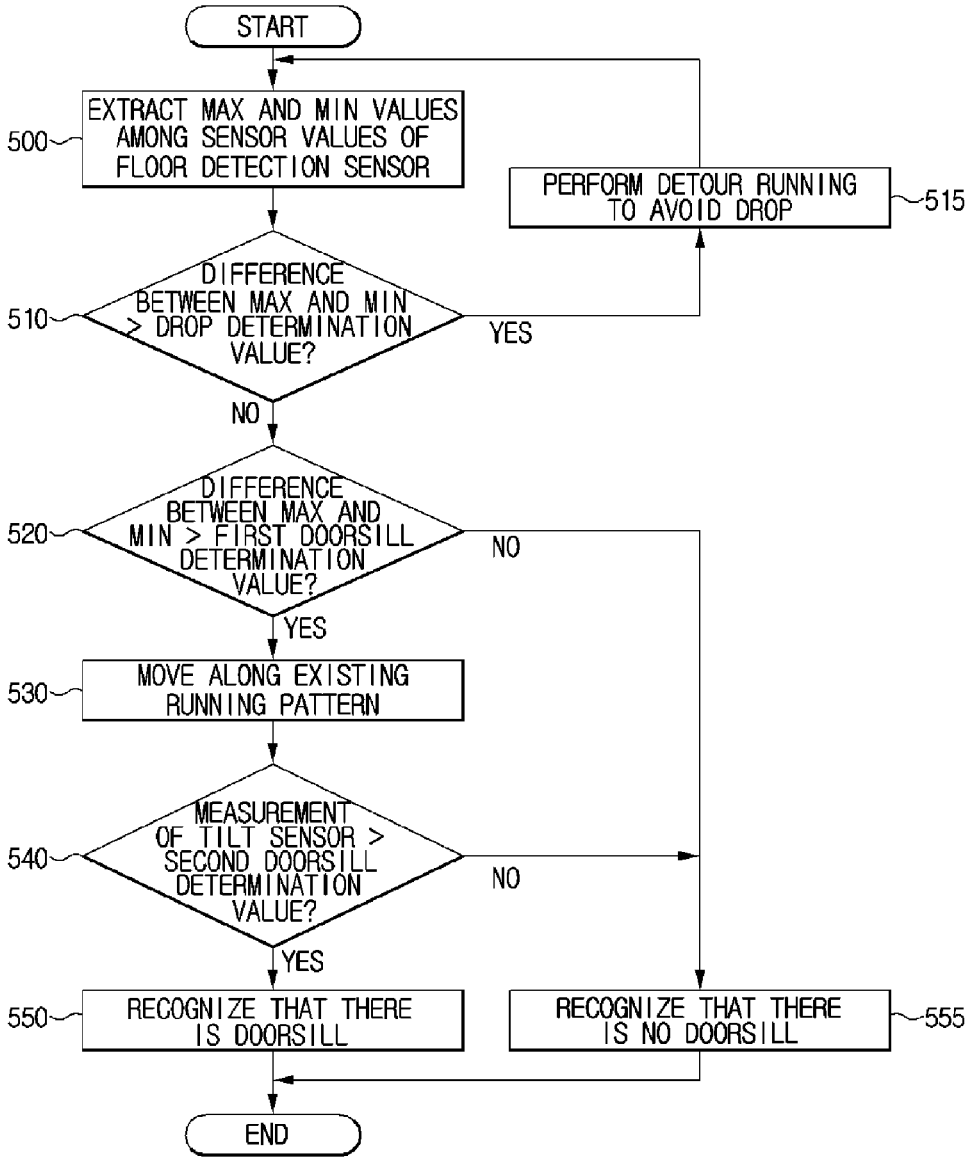
FIG. 9 is a flowchart illustrating a method for controlling a robot cleaner, according to an embodiment of the present disclosure.

FIG. 9 is a flowchart illustrating a method for controlling a robot cleaner, according to an embodiment of the present disclosure.

Specifically, the embodiment of FIG. 9 is directed to a method for controlling the robot cleaner to determine whether there is a doorsill.

Referring to FIG. 9, the robot cleaner 1 first extracts a maximum value and a minimum value among sensor values of the floor detection sensor 50, in operation 500. The floor detection sensor 50 detects a distance to the floor surface for each section of the multiple sections formed at intervals of a predetermined time T. The multiple sections may be classified into new time areas, each, i.e., the $m^{th}$ time area having a predetermined number of sections starting from the $m^{th}$ section (m is natural number, i.e., $m \geq 1$). The robot cleaner 1 extracts a maximum value and a minimum value among multiple sensor values detected by the floor detection sensor 50 for each time area. If there are multiple floor detection sensors 50, maximum and minimum values may be extracted from the sensor values output by a predetermined sensor among the multiple floor detection sensors 50, e.g., the first floor detection sensor 51 located at the front of the robot cleaner 1.

Next, the robot cleaner 1 recognizes whether there is a cliff by determining whether a difference between the extracted maximum value and minimum value exceeds the drop determination value, in operation 510.

If the difference exceeds the drop determination value, the robot cleaner 1 recognizes that there is a cliff and performs detour running or detour avoidance, in operation 515.

Otherwise, if the difference does not exceed the drop determination value, the robot cleaner 1 initially recognizes whether there is a doorsill by determining whether the difference exceeds the first doorsill determination value, in operation 520.

If the difference does not exceed the first doorsill determination value, the robot cleaner 1 recognizes that there is no doorsill, in operation 555.

Otherwise, if the difference exceeds the first doorsill determination value, the robot cleaner 1 initially recognizes that there is a doorsill and follows the existing running pattern for final determination, in operation 530.

The robot cleaner 1 finally recognizes whether there is a doorsill by determining whether a measurement of the tilt sensor 70 exceeds the second doorsill determination value, in operation 540. Although the robot cleaner 1 initially recognizes that there is a doorsill based on the difference between the maximum and minimum values of the floor detection sensor 50 in operation 530, the difference may exceed the first doorsill determination value even if there is a groove having a depth similar to the height of the doorsill. This is why the robot cleaner 1 uses the measurement of the tilt sensor 70 to make an additional determination for accurate determination about a doorsill. Specifically, if the main body 2 rests on a doorsill while following the existing running pattern, the main body 2 is inclined to one side and the robot cleaner 1 finally recognizes whether there is a doorsill from a measurement of the tilt sensor 70.

If the measurement of the tilt sensor 70 does not exceed the second doorsill determination value, the robot cleaner 1 recognizes and confirms that there is no doorsill, in operation 555.

If the measurement of the tilt sensor 70 exceeds the second doorsill determination value, the robot cleaner 1 finally recognizes and confirms that there is a doorsill, in operation 550.

In the final determination, the robot cleaner 1 may use a plurality of measurements output from the tilt sensor 70. Specifically, if all the consecutive measurements output from the tilt sensor 70 for a predetermined time exceed the second doorsill determination value, the controller 200 may finally recognize that there is a doorsill.

The method for controlling the robot cleaner in accordance with the aforementioned embodiments may be repeatedly performed until the end of vacuuming of the robot cleaner.

Figure 10:
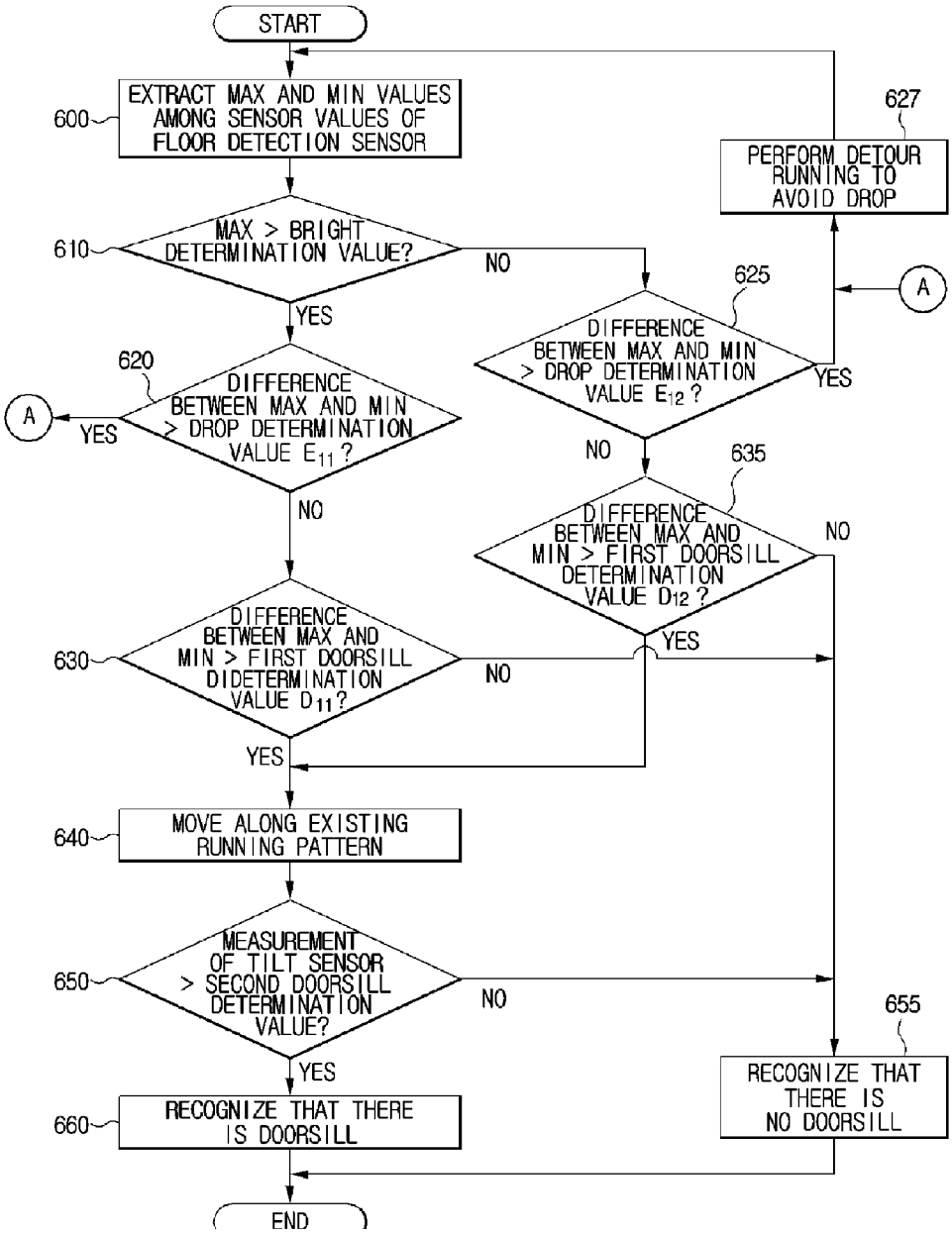
FIG. 10 is a flowchart illustrating a method for controlling a robot cleaner, according to another embodiment of the present disclosure.

FIG. 10 is a flowchart illustrating a method for controlling a robot cleaner to determine whether there is a doorsill, according to another embodiment of the present disclosure. Parts of the description that overlap with those of FIG. 9 will be omitted herein.

Referring to FIG. 10, the robot cleaner 1 first extracts a maximum value and a minimum value among sensor values of the floor detection sensor 50, in operation 600, which corresponds to operation 500 of FIG. 9.

The robot cleaner 1 determines whether the maximum value of the floor detection sensor 50 exceeds the brightness determination value, in operation 610. The brightness determination value refers to a threshold to distinguish whether the floor surface is bright or dark. Specifically, if the maximum value exceeds the brightness determination value, the floor surface is determined as being bright. Otherwise, if the maximum value does not exceed the brightness determination value, the floor surface is determined as being dark.

After determining whether the floor surface is bright or dark, the robot cleaner 1 recognizes whether there is a cliff by determining whether a difference between the extracted maximum value and minimum value exceeds the drop determination value. Specifically, if the maximum value exceeds the brightness determination value, i.e., the floor surface is determined as being bright, the robot cleaner 1 determines whether the difference between the maximum and minimum values exceeds a drop determination value E11 set for the bright floor surface, in operation 620. If the maximum value does not exceed the brightness determination value, i.e., the floor surface is determined as being dark, the robot cleaner 1 determines whether the difference between the maximum and minimum values exceeds a drop determination value E12 set for the dark floor surface, in operation 625.

In the determination of operation 620 or 625, if the difference exceeds the drop determination values, the robot cleaner 1 recognizes that there is a cliff and performs detour running, in operation 627.

Otherwise, in the determination of operation 620 or 625, if the difference does not exceed the drop determination values, the robot cleaner 1 initially recognizes whether there is a doorsill by determining whether the difference exceeds the first doorsill determination value. Specifically, if the maximum value exceeds the brightness determination value, i.e., the floor surface is determined as being bright, the robot cleaner 1 determines whether the difference between the maximum and minimum values exceeds a first doorsill determination value D11 set for the bright floor surface, in operation 630. If the maximum value does not exceed the brightness determination value, i.e., the floor surface is determined as being dark, the robot cleaner 1 determines whether the difference between the maximum and minimum values exceeds a first doorsill determination value D12 set for the dark floor surface, in operation 635.

In the determination of operation 630 or 635, if the difference does not exceed the first doorsill determination values, the robot cleaner 1 recognizes that there is no doorsill, in operation 655.

Otherwise, in the determination of operation 630 or 635, if the difference exceeds the first doorsill determination values, the robot cleaner 1 initially recognizes that there is a doorsill and follows the existing running pattern for final determination, in operation 640.

The robot cleaner 1 finally recognizes whether there is a doorsill by determining whether a measurement of the tilt sensor 70 exceeds the second doorsill determination value, in operation 650.

If the measurement of the tilt sensor 70 does not exceed the second doorsill determination value, the robot cleaner 1 recognizes and confirms that there is no doorsill, in operation 665. If the measurement of the tilt sensor 70 exceeds the second doorsill determination value, the robot cleaner 1 finally recognizes and confirms that there is a doorsill, in operation 660.

The method for controlling the robot cleaner in accordance with the aforementioned embodiments may be repeatedly performed until the end of vacuuming of the robot cleaner.

Figure 11:
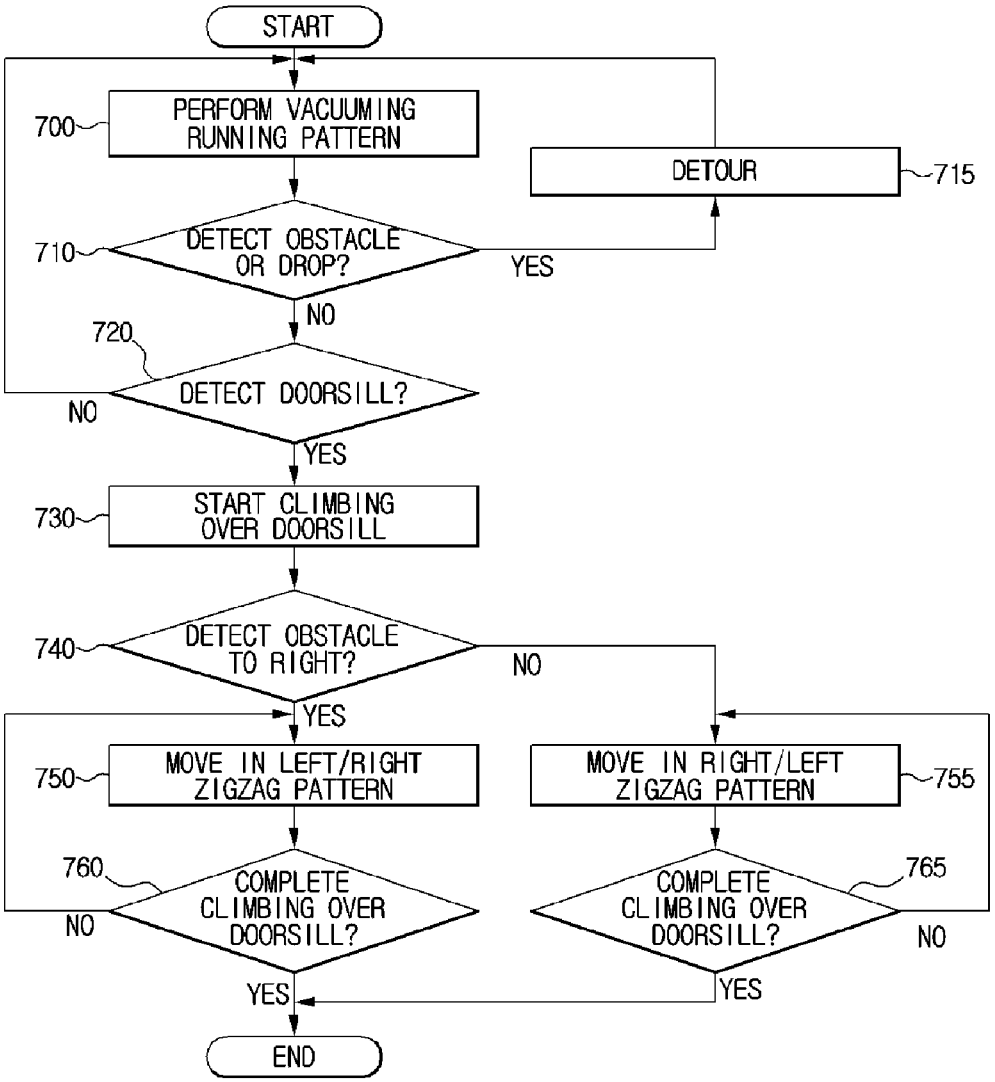
FIG. 11 is a flowchart illustrating a method for controlling a robot cleaner, according to another embodiment of the present disclosure.

FIG. 11 is a flowchart illustrating a method for controlling a robot cleaner, according to another embodiment of the present disclosure. Specifically, the embodiment of FIG. 11 illustrates a method for controlling a robot cleaner to climb over a doorsill when the doorsill is recognized.

Referring to FIG. 11, the robot cleaner 1 performs vacuuming while moving along a predetermined running pattern for a vacuuming area, in operation 700.

While moving around, the robot cleaner 1 determines whether there is an obstacle or a cliff, in operation 710.

If there is an obstacle or a cliff, the robot cleaner 1 performs detour running, in operation 715.

If there is no obstacle or cliff, the robot cleaner 1 determines whether there is a doorsill, in operation 720. How to determine whether there is a doorsill was described above, and thus the detailed description of the method will be omitted herein.

If recognizing that there is no doorsill, the robot cleaner 1 keeps following the existing running pattern as in operation 700.

Otherwise, if recognizing that there is a doorsill, the robot cleaner 1 starts climbing over the doorsill, in operation 730.

In climbing over the doorsill, the robot cleaner 1 may determine whether there is an obstacle such as a wall to the right of the doorsill, in operation 740. The obstacle being located to the right of the robot cleaner 1 means that the obstacle is located only to the right of the robot cleaner 1 or that the obstacle to the right is closer to the robot cleaner 1 than an obstacle to the left. The location of the obstacle may also be determined using a value output from the obstacle detection sensor 90.

If there is an obstacle to the right, the robot cleaner 1 climbs over the doorsill in the left/right zigzag pattern, in operation 750. The robot cleaner 1 determines whether it has climbed over the doorsill, in operation 760, and ends the vacuuming process if it is determined that the robot cleaner 1 has climbed over the doorsill, or otherwise, goes back to operation 750 to move along the left/right zigzag pattern.

If there is no obstacle to the right, the robot cleaner 1 climbs over the doorsill in the right/left zigzag pattern, in operation 755. The robot cleaner 1 determines whether it has climbed over the doorsill, in operation 760, and ends the cleaning process if it is determined that the robot cleaner 1 has climbed over the doorsill, or otherwise, goes back to operation 755 to move along the right/left zigzag pattern.

That is, the robot cleaner 1 repeats moving along the left/right or right/left zigzag pattern until the robot cleaner 1 completes to climb over the doorsill.

As described above, the running pattern of the robot cleaner 1 may be changed between the left/right and right left zigzag patterns depending on where an obstacle is in climbing over the doorsill, thereby preventing the main body 2 from colliding with the obstacle. Controlling the robot cleaner 1 to climb in a zigzag pattern may prevent the robot cleaner 1 from being caught by the doorsill and enable the robot cleaner 1 to follow the existing running pattern and direction even though the vacuuming area is divided by one or more doorsills.

The methods according to the above-described example embodiments may be recorded in non-transitory computer-readable media including program instructions to implement various operations embodied by a computer. The media may also include, alone or in combination with the program instructions, data files, data structures, and the like. The program instructions recorded on the media may be those specially designed and constructed for the purposes of the example embodiments, or they may be of the kind well-known and available to those having skill in the computer software arts. The media may also include, alone or in combination with the program instructions, data files, data structures, and the like. Examples of non-transitory computer-readable media include magnetic media such as hard disks, floppy disks, and magnetic tape; optical media such as CD ROM discs and DVDs; magneto-optical media such as optical discs; and hardware devices that are specially configured to store and perform program instructions, such as read-only memory (ROM), random access memory (RAM), flash memory, and the like.

Examples of program instructions include both machine code, such as produced by a compiler, and files containing higher level code that may be executed by the computer using an interpreter. The described hardware devices may be configured to act as one or more software modules in order to perform the operations of the above-described embodiments, or vice versa.

Any one or more of the software modules described herein may be executed by a dedicated hardware-based computer or processor unique to that unit or by a hardware-based computer or processor common to one or more of the modules. The described methods may be executed on a general purpose computer or processor or may be executed on a particular machine such as the robot cleaners described herein.

In accordance with embodiments of the present disclosure, a robot cleaner may properly move around and perform vacuuming by taking into account conditions of a floor surface. It may also smoothly climb over a doorsill and dynamically change its running pattern based on the presence/absence and position of an obstacle in climbing the doorsill. Ultimately cleaning ability and efficiency may be improved for multiple cleaning areas divided by doorsills.

Several embodiments have thus been described with respect to a robot cleaner and method for controlling the same, but it will be understood that various modifications can be made without departing the scope of the present disclosure. Thus, it will be apparent to those ordinary skilled in the art that the disclosure is not limited to the embodiments described, but can encompass not only the appended claims but the equivalents.

What is claimed is:

1. A robot cleaner comprising:

a main body forming an exterior;

a floor detection sensor for detecting a distance from the main body to a floor surface;

a tilt sensor for detecting an inclination of the main body; and a controller for determining whether there is a protruding part that protrudes from a floor surface in a running path of the main body, based on a first sensor value output by the floor detection sensor and a second sensor value output by the tilt sensor, to determine whether a difference between a maximum value and a minimum value among multiple first sensor values exceeds a predetermined first determination value, and to determine that there is the protruding part if the difference exceeds the first determination value.

2. The robot cleaner of claim 1, wherein the protruding part comprises a doorsill.

3. The robot cleaner of claim 1, wherein the controller is further configured to initially determine whether there is the protruding part based on the first sensor value, and to finally determine whether there is the protruding part based on the second sensor value.

4. The robot cleaner of claim 3, wherein the controller is further configured to initially determine whether there is the protruding part based on a difference between the first sensor values that vary in time.

5. The robot cleaner of claim 3, wherein the controller determines whether the difference between the maximum value and the minimum value among the multiple first sensor values exceeds the predetermined first determination value, for each time area in which multiple first sensor values are output.

6. The robot cleaner of claim 5, wherein the first determination value is set depending on a brightness level of the floor surface.

7. The robot cleaner of claim 3, wherein the controller is further configured to determine whether the second sensor value exceeds a predetermined second determination value, and finally determine that there is the protruding part if the second sensor value exceeds the second determination value.

8. The robot cleaner of claim 1, further comprising:

a driving unit for controlling drive wheels equipped in the main body to have the main body climb over the protruding part.

9. The robot cleaner of claim 8, wherein the driving unit is configured to control the drive wheels to drive the main body to climb over the protruding part in a zigzag running pattern.

10. The robot cleaner of claim 8, wherein the driving unit is configured to control the drive wheels to drive the main body along a running pattern that changes according to a position of an obstacle in climbing the protruding part.

11. The robot cleaner of claim 10, wherein the driving unit is configured to control the drive wheels to drive the main body in a left/right zigzag running pattern in which the main body moves to the left and then to the right, if there is an obstacle to the right of the protruding part.

12. The robot cleaner of claim 10, wherein the driving unit is configured to control the drive wheels to drive the main body in a right/left zigzag running pattern in which the main body moves to the right and then to the left, if there is an obstacle to the left of the protruding part.

13. A method for controlling a robot cleaner, the method comprising:

detecting a distance between a main body and a floor surface with a floor detection sensor;

detecting an inclination of the main body with a tilt sensor;

determining whether there is a protruding part that protrudes from a floor surface in a running path of the main body, based on a first sensor value output from the floor detection sensor and a second sensor value output from the tilt sensor; and determining whether a difference between a maximum value and a minimum value among multiple first sensor values exceeds a predetermined first determination value, and determining that there is the protruding part if the difference exceeds the first determination value.

14. The method of claim 13, wherein the protruding part comprises a doorsill.

15. The method of claim 13, wherein determining whether there is a protruding part comprises initially determining whether there is the protruding part based on the first sensor value, and finally determining whether there is the protruding part based on the second sensor value.

16. The method of claim 15, wherein determining whether there is a protruding part comprises:

initially determining whether there is the protruding part based on a difference between the first sensor values that vary in time.

17. The method of claim 15, wherein determining whether the difference between the maximum value and the minimum value among the multiple first sensor values exceeds the predetermined first determination value for each time area in which multiple first sensor values are output.

18. The method of claim 17, wherein the first determination value is set depending on a brightness level of the floor surface.

19. The method of claim 15, wherein determining whether there is a protruding part comprises:

determining whether the second sensor value exceeds a predetermined second determination value, and finally determining that there is the protruding part if the second sensor value exceeds the second determination value.

20. The method of claim 13, further comprising: controlling drive wheels equipped in the main body to have the main body climb over the protruding part.

21. The method of claim 20, wherein the controlling the drive wheels comprises:

controlling the drive wheels to drive the main body to climb over the protruding part in a zigzag running pattern.

22. The method of claim 20, wherein the controlling the drive wheels comprises:

controlling the drive wheels to drive the main body along a running pattern that changes according to a position of an obstacle in climbing the protruding part.

23. The method of claim 22, wherein the controlling the drive wheels comprises:

controlling the drive wheels to drive the main body in a left/right zigzag running pattern in which the main body moves to the left and then to the right, if there is an obstacle to the right of the protruding part.

24. The method of claim 22, wherein the controlling the drive wheels comprises:

controlling the drive wheels to drive the main body in a right/left zigzag running pattern in which the main body moves to the right and then to the left, if there is an obstacle to the left of the protruding part.

25. A method of controlling a robot cleaner configured to clean a floor surface, the method comprising:

detecting an obstacle;

determining whether the obstacle is on a first side or a second side of the robot cleaner;

detecting whether there is a protrusion from the floor surface; controlling the robot cleaner to move in a first pattern to climb the protrusion and to avoid the obstacle if the obstacle is determined as being on the first side or to move in a second pattern to climb the protrusion and to avoid the obstacle if the obstacle is determined as being on the second side; and determining whether a difference between a maximum value and a minimum value among multiple first sensor values exceeds a predetermined first determination value, and determining that there is a protrusion if the difference exceeds the first determination value.

26. The method of claim 24, wherein the first pattern comprises a zigzag pattern moving away from the obstacle on the first side and then toward the obstacle on the first side and the second pattern comprises a zigzag pattern moving away from the obstacle on the second side and then toward the obstacle on the second side.

27. A robot cleaner comprising:

a tilt sensor for measuring an inclination amount of the robot cleaner;

a first floor detection sensor, disposed at a front portion of the robot cleaner, for detecting a first distance from a floor to the robot cleaner;

a second floor detection sensor, disposed at a portion of the robot cleaner other than the front portion, for detecting a second distance from the floor to the robot cleaner;

a controller to extract minimum and maximum values among sensor values of the first and second floor detection sensor, and to determine that the robot cleaner is climbing a protrusion from the floor surface when the difference between the minimum and maximum values is determined to be greater than a first threshold and when the inclination amount of the tilt sensor exceeds a second threshold.

* * * * *